US007101143B2

(12) United States Patent
Orthaus et al.

(10) Patent No.: US 7,101,143 B2
(45) Date of Patent: Sep. 5, 2006

(54) TRAFFIC CONE RETRIEVING DEVICE FOR REMOVING TRAFFIC CONES FROM ROADWAY SURFACES

(75) Inventors: Chad Orthaus, Alexandria, MN (US); Merwin Anderson, Glenwood, MN (US); Jamie Zimmerman, Miltona, MN (US); Bertrum England, Farwell, MN (US); George Hammond, Nelson, MN (US); Jeffrey Arnold Wilkens, Reiles Acres, ND (US)

(73) Assignee: Illinois Tool Works Inc., Glenview, IL (US)

( * ) Notice: Subject to any disclaimer, the term of this patent is extended or adjusted under 35 U.S.C. 154(b) by 654 days.

(21) Appl. No.: 10/247,579

(22) Filed: Sep. 20, 2002

(65) Prior Publication Data

US 2004/0057824 A1 Mar. 25, 2004

(51) Int. Cl.
*B65G 57/30* (2006.01)

(52) U.S. Cl. ..... 414/788.2; 414/551; 414/802

(58) Field of Classification Search ..... 414/788.2, 414/788.1, 188.3, 551, 552, 555, 801, 802
See application file for complete search history.

(56) References Cited

U.S. PATENT DOCUMENTS

| | | | | |
|---|---|---|---|---|
| 4,597,706 | A * | 7/1986 | Michit | 414/788.2 |
| 5,054,648 | A | 10/1991 | Luoma | |
| 5,213,464 | A | 5/1993 | Nicholson et al. | |
| 5,244,334 | A | 9/1993 | Akita et al. | |
| 5,525,021 | A * | 6/1996 | Larguier | 414/551 |
| 6,056,498 | A | 5/2000 | Velinsky et al. | |
| 6,158,948 | A | 12/2000 | Calvert | |
| 6,726,434 | B1 * | 4/2004 | Orthaus et al. | 414/539 |

* cited by examiner

*Primary Examiner*—Khoi H. Tran
(74) *Attorney, Agent, or Firm*—Schwartz & Weinrieb

(57) ABSTRACT

Apparatus and method for retrieving traffic cones from roadway surfaces comprises a framework which is adapted to be attached to a roadwork vehicle so as to be movable therewith along a roadway surface. A knock-down bar upon the framework knocks down a normally upstanding traffic cone, and a substantially horizontally oriented, substantially conically configured spearing mechanism mounted upon the framework is inserted into the hollow interior of the traffic cone. The spearing mechanism and traffic cone are pivoted to a vertical orientation, and subsequently elevated so as to place the traffic cones onto a platform in a nested stacked array.

27 Claims, 19 Drawing Sheets

TRAFFIC CONE RETRIEVING DEVICE FOR REMOVING TRAFFIC CONES FROM ROADWAY SURFACES

FIELD OF THE INVENTION

The present invention relates generally to the retrieval of traffic cones, which have been previously deposited at predeterminedly spaced locations of roadway surfaces in accordance with predeterminedly timed sequences, from the roadway surfaces, and more particularly to a new and improved traffic cone retrieving device, mechanism, apparatus, or system for automatically removing or retrieving the traffic cones, which have been previously deposited at predeterminedly spaced locations of roadway surfaces in accordance with predeterminedly timed sequences, from the roadway surfaces.

BACKGROUND OF THE INVENTION

Traffic cones are a ubiquitous sight upon the nation's roadways whether they are being used, for example, to visually indicate to motorists either the presence of a construction site, to delineate and separate moving lanes of traffic from roadside work zones, to close particular street regions to oncoming traffic, or the like. As is well known, a supply of traffic cones is usually carried upon a roadwork truck or vehicle operated either by means of a local government agency or a subcontractor organization hired by the local government, and as is often the case, the traffic cones are manually deposited or placed upon the particular roadway by means of operator or workmen personnel who take individual traffic cones from a supply of such cones carried upon the roadwork truck or vehicle and place the individual traffic cones upon the roadway surface at predeterminedly spaced intervals along the particular route being travelled by the roadwork truck or vehicle. In accordance with one mode of operation, the operator or workmen personnel may be positioned upon one side of the roadwork truck or vehicle, and while effectively hanging onto, for example, a rail member, or similar support, of the roadwork truck or vehicle by means of one arm, the operator or workman places a traffic cone onto the roadway with his or her other arm. Alternatively, an individual operator or workman will often sit upon a rear bed, deck, or platform portion of the roadwork vehicle or truck so as to be capable of periodically depositing the traffic cones along the roadway as the roadwork vehicle or truck moves along the particular route along which the traffic cones are to be deposited.

As can readily be appreciated, the aforenoted well-known modes of operation present significant safety problems for the operators or workmen personnel in that the operators or workmen personnel are disposed in precarious positions or orientations upon the roadwork truck or vehicle. Incidents have in fact occurred, for example, during such traffic cone placement or deposition operations, wherein workmen or operator personnel have accidentally fallen from the trucks or vehicles and have either suffered serious injuries, or even worse, have suffered injuries which have proven to be fatal. These situations are not of course entirely unanticipated in view of the fact that sometimes unexpected events occur during movement of the roadwork truck or vehicle alongside ongoing traffic. These events may cause, for example, the particular roadwork truck or vehicle to undergo somewhat sudden movements comprising a change in direction, necessary braking or acceleration, or the like. In addition, it is sometimes difficult for the workmen personnel or operators to simultaneously pick up and then properly control the disposition and placement of the traffic cones onto the roadway surface in view of the fact that each traffic cone weighs at least ten pounds depending upon the particular cone and its size. All of such movements, and the weight force inherent to each traffic cone, can cause destabilizing forces to effectively be impressed upon or transmitted to the operators or workmen personnel which can of course lead to the afore-noted unfortunate injury or death situations to occur as a result of an operator or workman either losing his or her balance, or losing his or her hand-held grip upon the truck or vehicle support structure. Still further, the constant lifting and manipulation of the traffic cones is not ergonomically desirable from a health point of view for the operators or workmen personnel.

In a similar manner, once the traffic cones, which have previously been set or deposited at predeterminedly spaced locations of the roadway surface in accordance with predeterminedly timed sequences, are no longer needed, due for example, to the fact that the particular construction or roadwork has been completed, or that the need to close particular street regions to oncoming traffic is no longer required, then the traffic cones must obviously be retrieved or removed from the roadway surface. As was the case with the procedures or modes of operation by means of which the traffic cones were set or deposited onto the roadway surfaces, conventional retrieval or removal procedures practiced by roadwork operators or workmen personnel have likewise not been able to be achieved in a manner which is relatively safe for the operators or workman personnel. For example, in connection with the removal or retrieval of the traffic cones from the roadway surfaces, operators or workmen personnel have conventionally walked behind the roadwork truck or vehicle and manually loaded the traffic cones back onto the rear bed or deck region of the truck. Obviously, such a mode of operation exposes the operators or workmen personnel to dangers presented by means of ongoing vehicular traffic which are passing the construction or work zones within adjacent traffic lanes. In addition, as was the case with the manual deposition of the traffic cones onto the roadway surfaces, the constant lifting and manipulation of the traffic cones is not ergonomically desirable from a health point of view for the operators or workmen personnel.

In order to overcome such operational drawbacks characteristic of manual procedures for retrieving and removing traffic cones from roadway surfaces, several automated systems have been proposed such as those systems disclosed, for example, within U.S. Pat. No. 6,158,948 which issued to Calvert on Dec. 12, 2000, U.S. Pat. No. 6,056,498 which issued to Velinsky et al. on May 2, 2000, U.S. Pat. No. 5,244,334 which issued to Akita et al. on Sep. 14, 1993, U.S. Pat. No. 5,213,464 which issued to Nicholson et al. on May 25, 1993, or U.S. Pat. No. 5,054,648 which issued to Luoma on Oct. 8, 1991. While all of such disclosed systems comprise implements for removing the traffic cones from the roadway surface, several of such systems comprise several integrated systems which effectively render the overall system extremely complex. In addition, none of such systems comprise, in effect, a single implement for not only removing the traffic cones from the roadway surface, but in addition, for stacking the retrieved traffic cones into nested groups for simplifying storage of the traffic cones.

A need therefore exists in the art for a new and improved device, mechanism, system, or apparatus for automatically retrieving and removing traffic cones from roadway surfaces, and for stacking the removed traffic cones within nested arrangements so as to efficiently store the same, wherein as a result of the provision of such a system or apparatus, the operators or workmen personnel are not exposed to the dangers of oncoming traffic, and wherein the traffic cones can be readily, easily, and efficiently retrieved and removed without adversely affecting the workmen or operator personnel from an ergonomically healthful and non-fatiguing point of view.

OBJECTS OF THE INVENTION

Accordingly, it is an object of the present invention to provide a new and improved device, mechanism, system, or apparatus for removing or retrieving traffic cones, which have been previously set or deposited onto roadway surfaces, from the roadway surfaces.

Another object of the present invention is to provide a new and improved device, mechanism, system, or apparatus for removing or retrieving traffic cones, which have been previously set or deposited onto roadway surfaces, from the roadway surfaces wherein the operationally unsafe conditions characteristic of conventional manual traffic cone retrieval or removal techniques or procedures can be effectively overcome, and yet, the apparatus of the present invention will simplify the retrieval and stacking of the traffic cones.

An additional object of the present invention is to provide a new and improved device, mechanism, system, or apparatus for removing or retrieving traffic cones, which have been previously set or deposited onto roadway surfaces, from the roadway surfaces and which comprises a substantially automatic device, mechanism, system, or apparatus.

A further object of the present invention is to provide a new and improved device, mechanism, system, or apparatus for retrieving or removing traffic cones, which have been previously set or deposited onto roadway surfaces, from the roadway surfaces and which comprises a substantially automatic device, mechanism, system, or apparatus which enables operator or workmen personnel to be positioned at a location or work station which is substantially safe such that the operators or workmen personnel are not unduly exposed to the dangers inherently generated by surrounding vehicular traffic.

A last object of the present invention is to provide a new and improved device, mechanism, system, or apparatus for removing or retrieving traffic cones, which have been previously set or deposited onto roadway surfaces, from the roadway surface and which comprises a substantially automatic device, mechanism, system, or apparatus which enables operators or workmen personnel to be positioned at a location or work station which is substantially safe such that the operators or workmen personnel are not unduly exposed to the dangers inherently generated by surrounding vehicular traffic, and in addition, wherein the traffic cones can be readily, easily, and efficiently retrieved and removed from the roadway surfaces without adversely affecting the workmen or operator personnel from an ergonomically healthful and non-fatiguing point of view.

SUMMARY OF THE INVENTION

The foregoing and other objectives are achieved in accordance with the teachings and principles of the present invention through the provision of a new and improved device, mechanism, system, or apparatus for retrieving and removing traffic cones, which have been previously set or deposited onto roadway surfaces, from the roadway surface. The device, mechanism, system, or apparatus of the present invention for retrieving and removing the traffic cones comprises a cage-type framework which is adjustably mounted and secured to a side portion of the roadwork truck or vehicle and which is rollably supported upon the roadway by means of at least one wheel mounted upon the bottom portion of the framework.

The bottom portion of the framework is also provided with a pair of arms which together effectively define a convergent scoop or guide portion for initially encountering a traffic cone disposed upon the roadway and for guiding the traffic cone toward the cage-type framework. A horizontally disposed bar is disposed at an elevational level upon the framework for encountering an upper region of the traffic cone, as the roadwork vehicle or truck is moved along the roadway, so as to effectively cause the traffic cone to be knocked over or knocked down from its vertical orientation upon the roadway surface to a horizontally disposed orientation. An elevating mechanism, comprising a substantially conically-shaped fin member or structure integrally fixed upon a movable support platform, is adapted to be inserted into the open bottom end of the horizontally disposed traffic cone so as to effectively spear the same, whereupon pivotal movement of the elevating mechanism, the traffic cone is reoriented from its horizontal disposition to a vertically oriented disposition. The elevating mechanism can then be vertically elevated whereby the retrieved and removed cones can effectively be disposed in a nested array upon a fixed platform of the framework so as to continuously accumulate the traffic cones as they are serially retrieved and removed from the particular roadway surface. A kicker device is also incorporated into the present invention for initially erecting a traffic cone which is already disposed in a horizontal mode or orientation upon the roadway surface but which has its base and apex portions oriented in the wrong directions.

BRIEF DESCRIPTION OF THE DRAWINGS

Various other objects, features, and attendant advantages of the present invention will be more fully appreciated from the following detailed description when considered in connection with the accompanying drawings in which like reference characters designate like or corresponding parts throughout the several views, and wherein.

DETAILED DESCRIPTION OF THE PREFERRED EMBODIMENT

Figure 3:
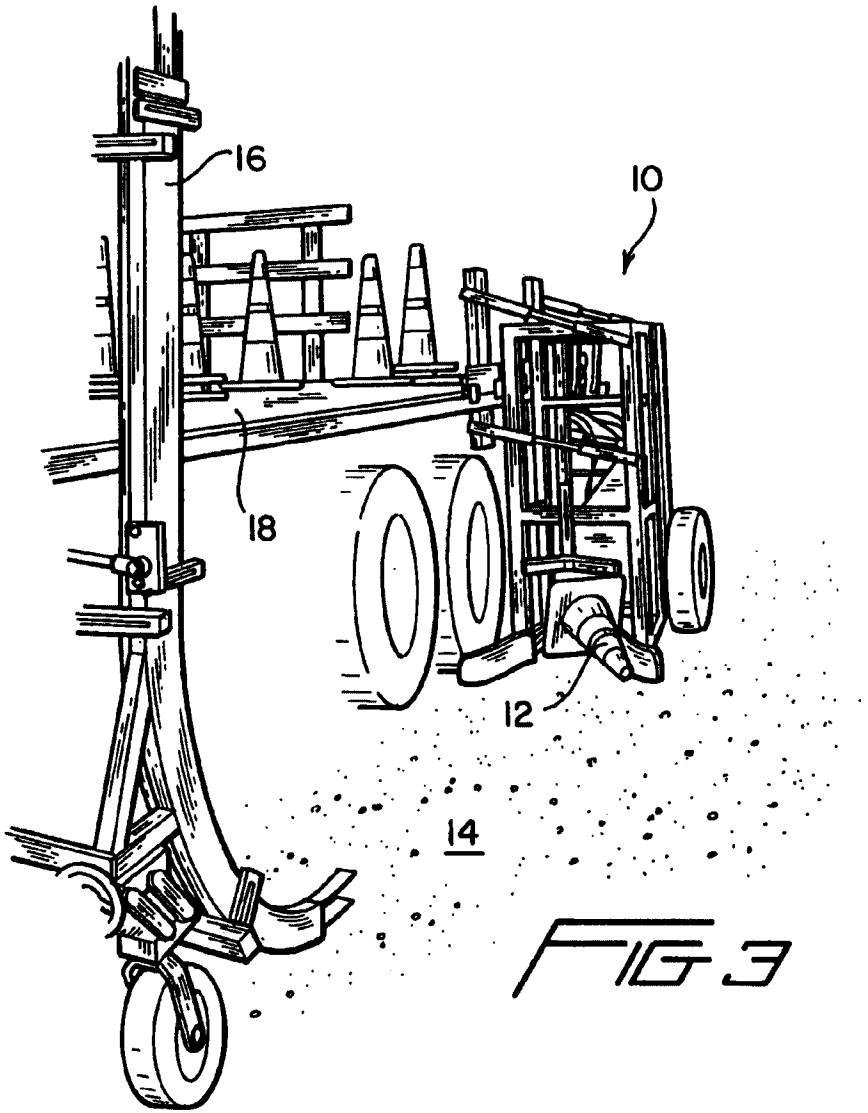
FIG. 3 is a perspective view similar to that of FIG. 1 wherein the traffic cone has now been knocked over or knocked down so as to be disposed in its horizontal orientation in preparation for being speared by means of the elevating mechanism.

Referring now to the drawings, and more particularly to FIGS. 1–5 thereof, the new and improved system or apparatus for automatically retrieving and removing traffic cones, which have been previously set or deposited upon a roadway surface, from the roadway surface is illustrated and is generally indicated by the reference character 10. Individual traffic cones 12 may have been previously placed or deposited at predetermined locations of the roadway surface 14 either manually by means of an operator or roadwork workman, or by semi-automatic or automatic means as disclosed, for example, at 16, wherein such semi-automatic or automatic means is disclosed in complete detail within U.S. patent application Ser. No. 10/247,834, entitled TRAFFIC CONE SETTING DEVICES FOR DEPOSITING TRAFFIC CONES ONTO ROADWAY SURFACES, and filed simultaneously herewith. As was the case with the traffic cone setting device 16 for depositing the traffic cones 12 onto the roadway surface 14, the traffic cone retrieving and removing system or apparatus 10 of the present invention is adapted to be adjustably mounted upon one side of a roadwork truck or vehicle 18, and is adapted to retrieve and remove the individual traffic cones 12 from the roadway surface 14 in accordance with a precisely controlled stepwise manner, method, or mode of operation.

Figure 1:
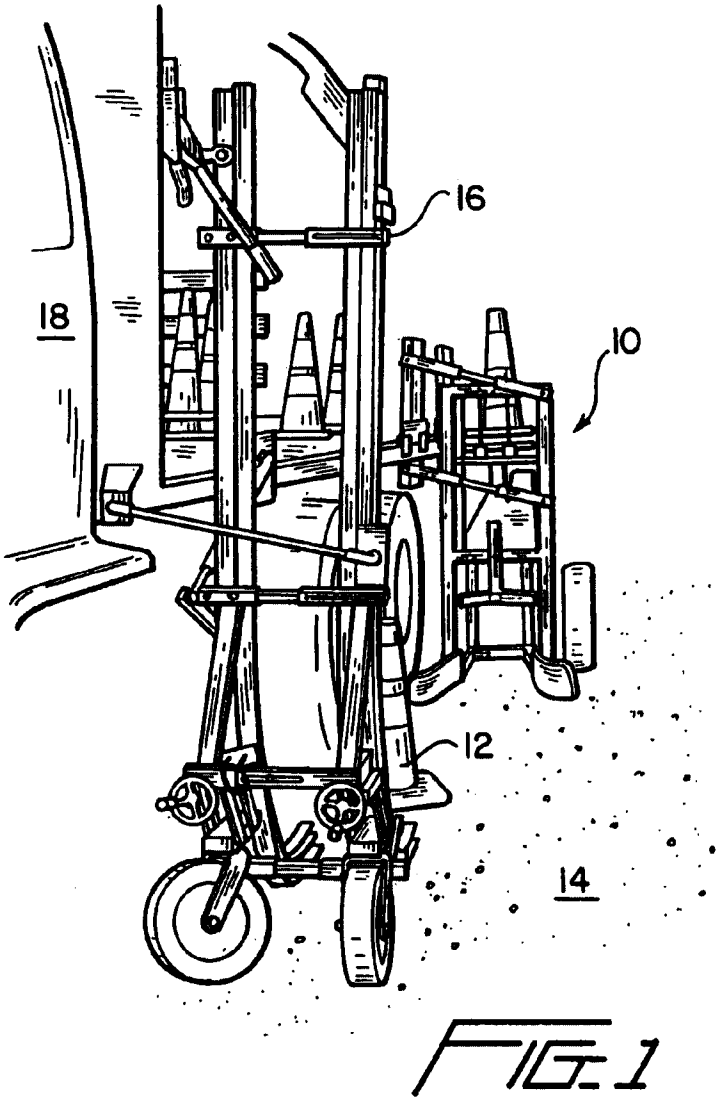
FIG. 1 is a rearward-facing perspective view of a roadwork truck or vehicle having a new and improved system or apparatus, for retrieving and removing traffic cones, which have been previously set or deposited onto a roadway surface, from the roadway surface, fixedly mounted upon a side portion of the roadwork truck or vehicle, wherein the system or apparatus is shown approaching a traffic cone so as to retrieve and remove the same from the roadway surface.
Figure 2:
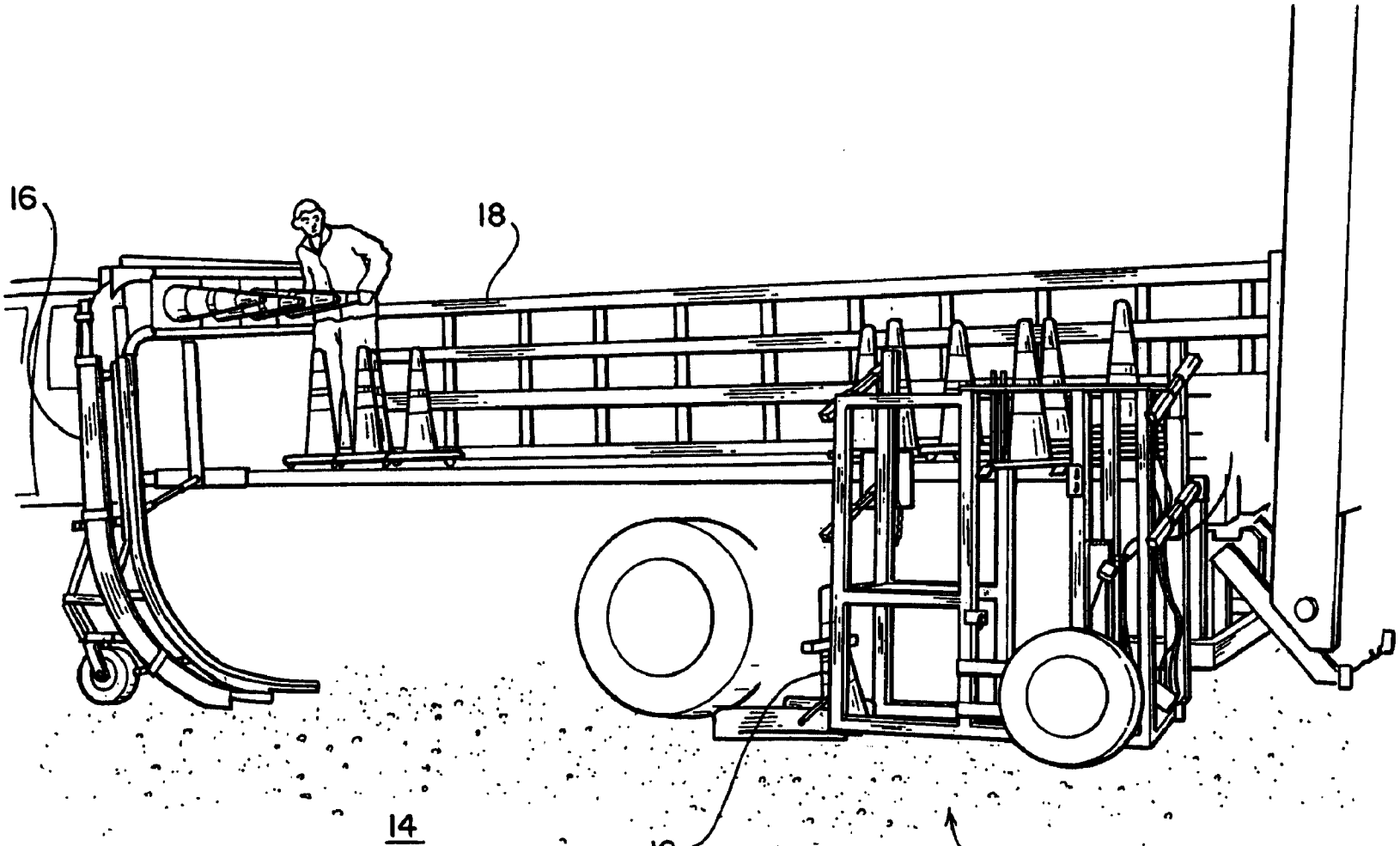
FIG. 2 is a sideward-facing perspective view of the roadwork truck or vehicle and the new and improved system or apparatus as disclosed within FIG. 1 wherein the traffic cone has effectively entered the forwardly extending scoop portion of the framework of the system or apparatus in preparation for being knocked down or knocked over so as to have its orientation changed from vertical or horizontal.
Figure 4:
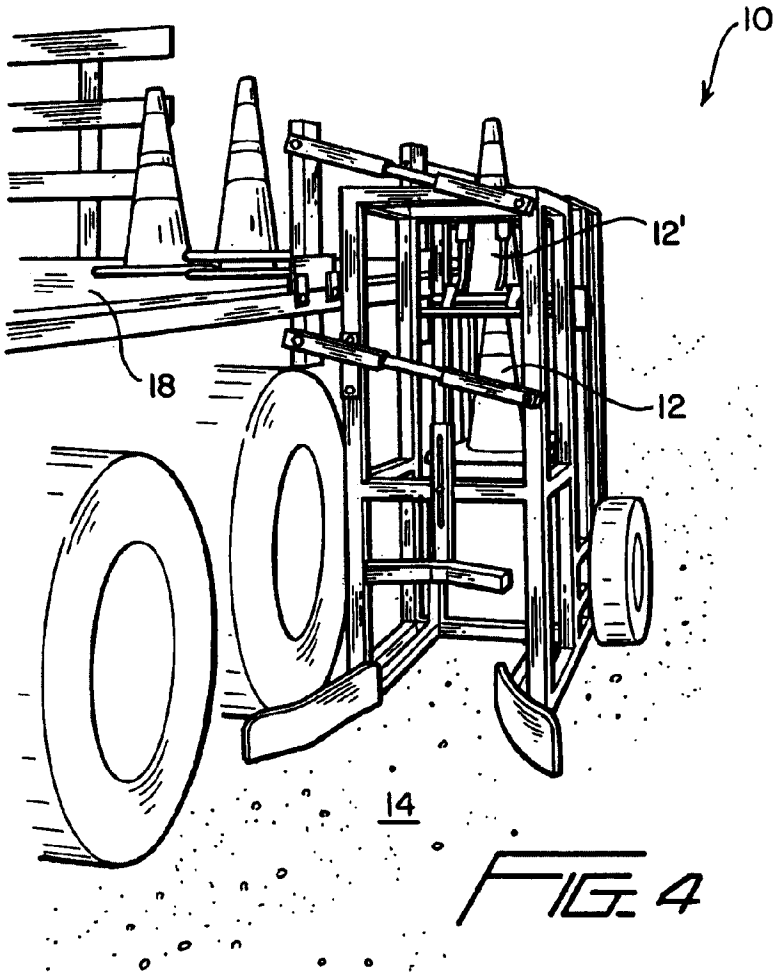
FIG. 4 is a perspective view similar to that of FIGS. 1 and 3 showing the traffic cone disposed in its vertical orientation and being elevated within the cage-type framework by means of the system or apparatus elevating mechanism in preparation for the traffic cone being disposed in a nested and stacked array upon the fixed platform structure of the framework.

More particularly, and briefly with respect to the overall method or mode of operation, it can be initially appreciated from FIG. 1 that, when a particular, vertically upstanding traffic cone 12 is to be retrieved and removed from the roadway surface 14, the system or apparatus 10 is initially disposed behind, or rearwardly of, the particular traffic cone 12 and is moved forwardly toward the traffic cone 12 as the roadwork vehicle or truck 18 moves in a forward direction. FIG. 2 illustrates the disposition of the system or apparatus 10 with respect to the traffic cone 12 such that the traffic cone 12 has effectively entered an interior portion of the apparatus or system 10, and as will be explained in more detail hereinafter, the system or apparatus 10 further comprises a structural component which is fixedly mounted thereon for knocking over or knocking down the traffic cone 12 such that the traffic cone 12 is now disposed upon the roadway surface 14 in a horizontal orientation as illustrated in FIG. 3. Continuing further, additional structure is movably mounted upon the system or apparatus 10 for operatively engaging the traffic cone 12 while the same is disposed in its horizontal orientation and for pivotally moving the traffic cone 12 such that the traffic cone 12 can achieve a vertical orientation as illustrated in FIG. 4. The system or apparatus 10 also comprises means for elevationally moving the traffic cone 12 vertically upwardly such that one or more of the traffic cones 12' can be supported within the system or apparatus 10, as respectively disclosed within FIGS. 4 and 5, either singly or within a stacked and nested array.

Figure 7:
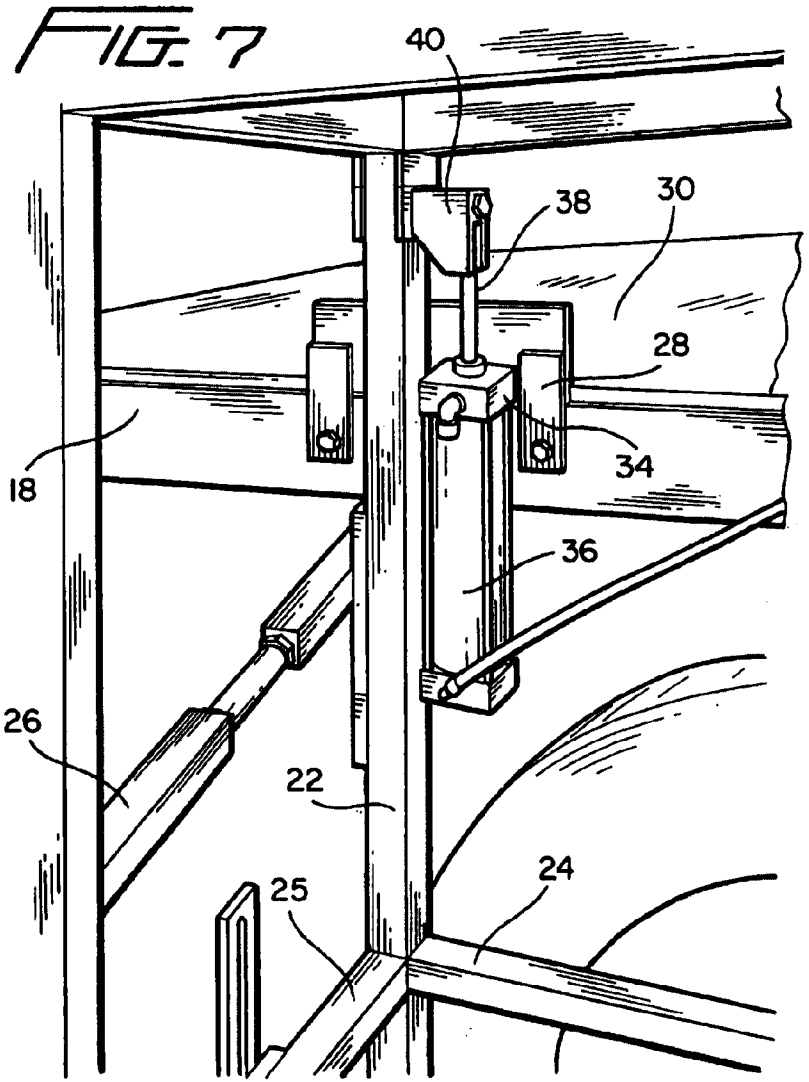
FIG. 7 is a perspective view illustrating one of the float cylinder mechanisms utilized in conjunction with the cage-type framework for counteracting the weight forces of the framework such that all of the weight forces are not necessarily or solely supported by means of the single wheel assembly mounted upon the framework of the apparatus or system.
Figure 6:
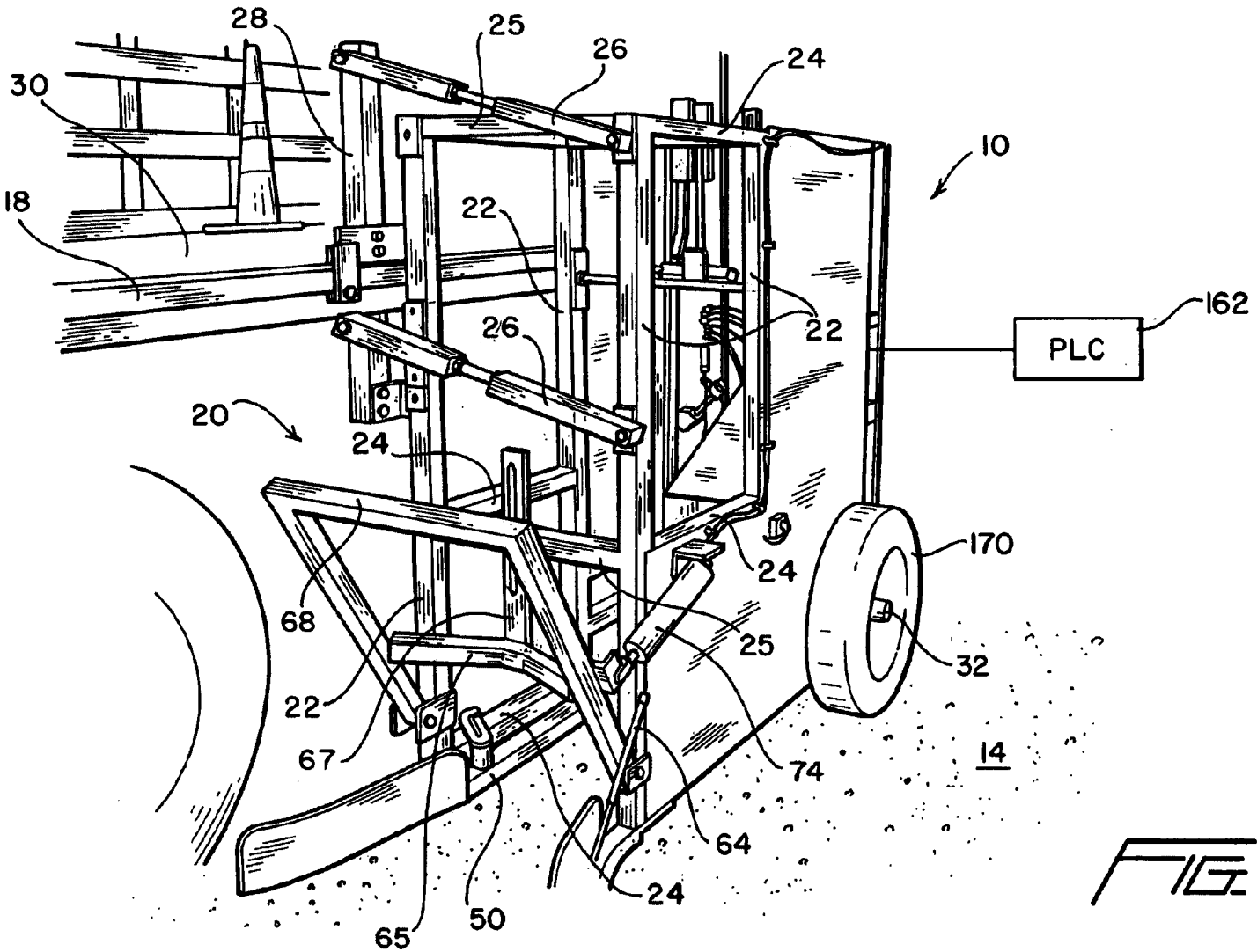
FIG. 6 is a perspective external view, similar to that of FIG. 4, showing in greater detail the new and improved system or apparatus, for retrieving and removing traffic cones, which have been previously set or deposited onto a roadway surface, from the roadway surface, as fixedly mounted upon a side portion of the roadwork truck or vehicle.

With reference now being made to FIGS. 6 and 7, it is seen that the system or apparatus 10 of the present invention 10 comprises a framework structure 20 which, more particularly, comprises a plurality of vertically oriented, longitudinally and transversely spaced beam members 22. In addition, a plurality of horizontally disposed, vertically spaced longitudinally oriented beam members 24, and a plurality of horizontally disposed, vertically spaced, transversely oriented cross-beam members 25, fixedly interconnect the vertically oriented beam members 22 together. In order to properly and adjustably support the framework structure 20 upon, and with respect to, the roadwork truck or vehicle 18, a pair of substantially horizontally oriented, vertically spaced turnbuckle members 26 are respectively disposed at both the front and rear end regions of the framework structure 20, and each one of the turnbuckle members 26 has its opposite ends pivotally connected to the framework structure 20 and to the roadwork vehicle or truck 18. More particularly, a vertically oriented mounting bracket assembly 28 is fixedly mounted upon a side rail portion 30 of the roadwork truck or vehicle 18, and an inner or proximal end portion of each one of the turnbuckle members 26 is pivotally mounted upon the mounting bracket assembly 28, while an outer or distal end portion of each one of the turnbuckle members 26 is pivotally mounted upon an outer one of the vertically oriented beam members 22, that is, those vertically oriented beam members 22 which are relatively remote from the roadwork truck or vehicle 18. A rear, ground-engaging wheel assembly 32 is also rotatably mounted upon the outer rear portion of the framework structure 20 in order to permit the entire system or apparatus 10 to be rollably transported along the roadway surface 14 as the roadwork truck or vehicle 18 moves along the roadway surface 14.

As a result of adjustments that can be made to individual ones of the plurality of turnbuckle members 26 in accordance with well-known techniques, the relative inclination of the outermost vertically oriented beam members 22, collectively defining the outer side of the framework structure 20, can be altered or adjusted such that, in turn, the weight forces of the system or apparatus 10, which are effectively impressed upon the wheel assembly 32, can be appropriately balanced or controlled. In addition to such turnbuckle structure, and in a similar manner, as can best be seen from FIG. 7, a pneumatic floating cylinder assembly 34 is operatively associated with each one of the vertically oriented beam members 22 disposed upon the inner side of the framework structure 20 so as to likewise assist in the offsetting or counterbalancing of the weight forces of the system or apparatus 10. More particularly, each pneumatic floating cylinder assembly 34 comprises a cylinder housing 36 which is fixedly mounted upon the mounting bracket assembly 28, and a piston rod member 38 which is operatively connected to an inner one of the vertically oriented beam members 22 by means of an auxiliary mounting bracket assembly 40. It can therefore be readily appreciated that as a result of the relative extension or retraction of the piston rod member 38 of each one of the pneumatic floating cylinder assemblies 34, the elevational disposition of such inner, vertically oriented beam members 22 can be appropriately adjusted such that the weight forces and weight distribution of the inner side of the framework structure 20, relative to the roadwork vehicle or truck 18, as well as with respect to the wheel assembly 32, can be selectively adjusted or controlled.

Figure 8A:
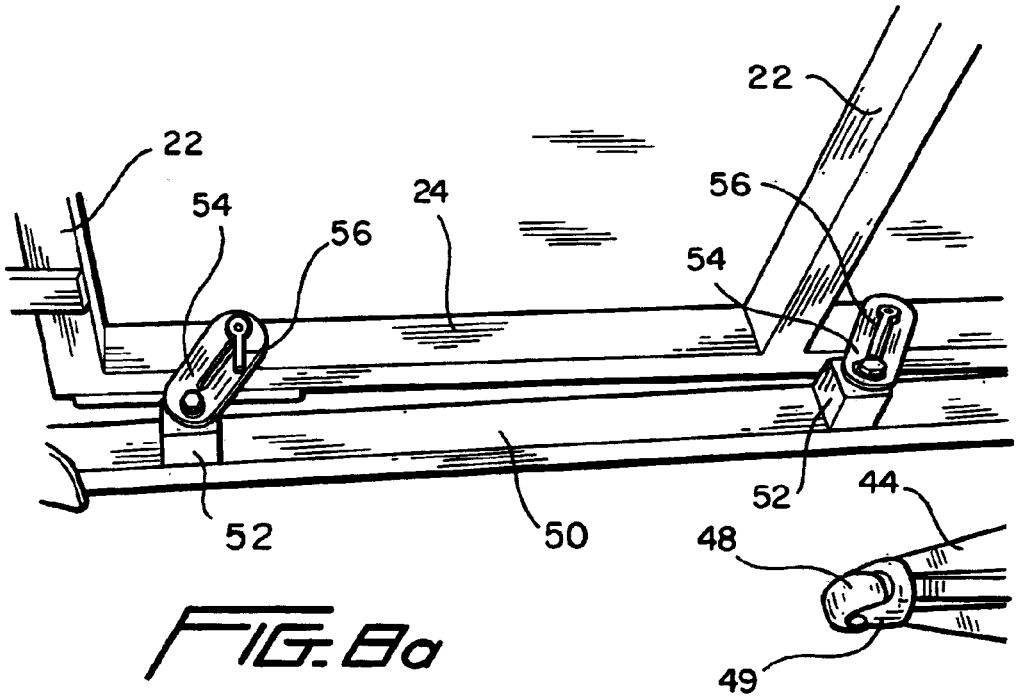
FIG. 8*a* is a substantially top plan view of the interior portion of the lower framework region as illustrated in FIG. 8 showing in particular the adjustment structure of the guide mechanism, as mounted upon the lowermost portion of the framework, for guiding the traffic cone into the internal region of the framework so as to be properly engaged by the traffic cone spear mechanism illustrated in FIG. 8.
Figure 8:
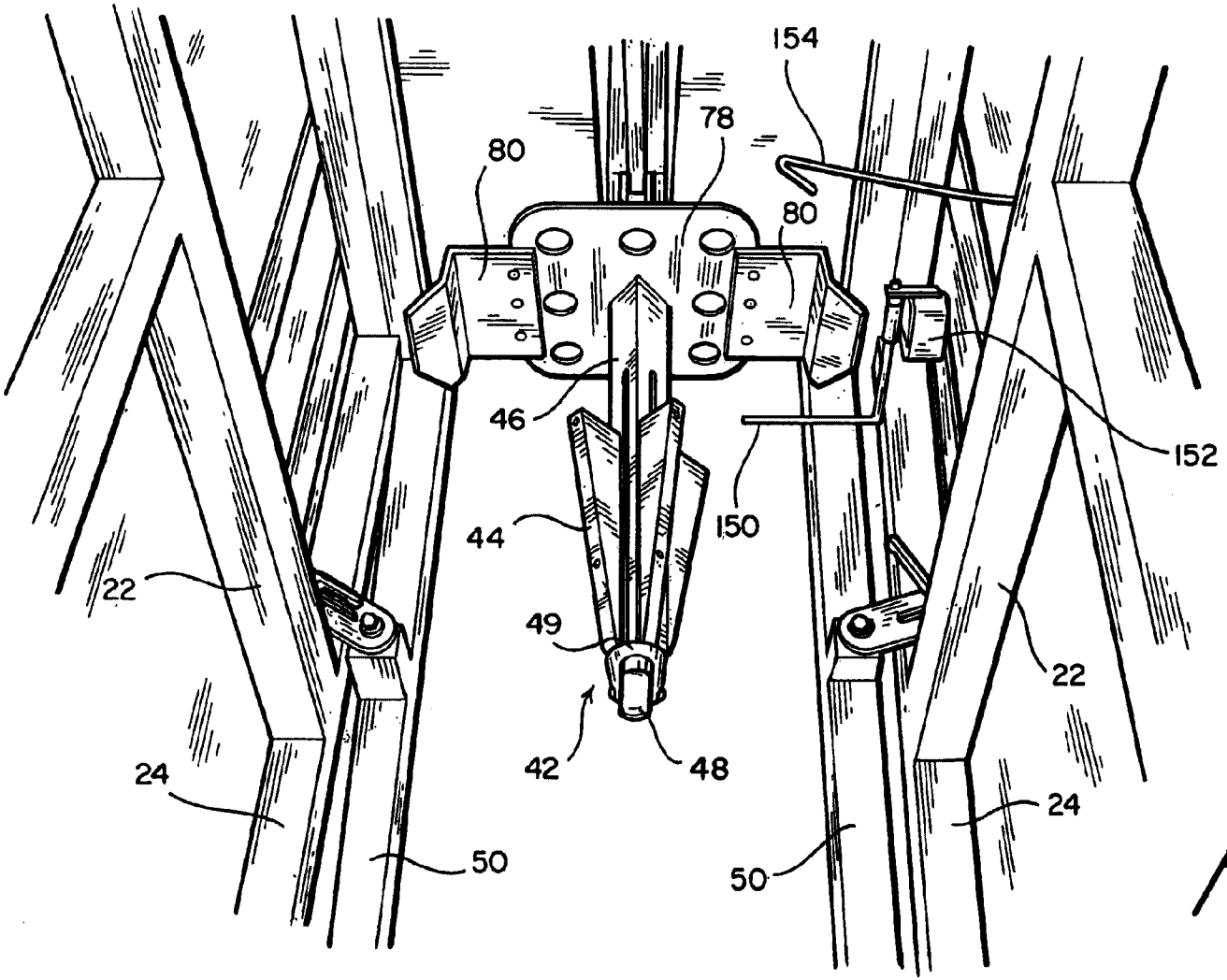
FIG. 8 is a perspective view illustrating the traffic cone spear mechanism operatively disposed internally within the framework of the apparatus or system for operatively engaging a knocked-down traffic cone as shown in FIG. 3 so as to erect the same to a vertically upstanding orientation in preparation for stacking or nesting within the framework as illustrated within FIGS. 4 and 5.

With reference now being made to FIGS. 8 and 8*a*, it is seen that a traffic cone spear mechanism 42 is disposed internally within the framework structure 20, as best seen in FIG. 8. The spear mechanism 42 comprises a plurality of fin members 44 which are fixedly mounted upon an axially oriented post or mast 46 so as to effectively define together a conical structure which has an external configuration which is substantially similar to the hollow, interior conical region of a traffic cone, and a roller or wheel 48 is rotatably mounted upon the forwardmost end portion of the conically configured spear mechanism 42 by means of a suitable clevis-type mounting bracket 49. Each one of the lowermost horizontally disposed, longitudinally oriented beam members 24 of the framework structure 20 has a longitudinally extending guide rail member 50 operatively associated therewith by means of which each traffic cone 12 may be properly longitudinally guided toward the spear mechanism 42 once the particular traffic cone 12 has entered the framework structure 20 after being knocked down or knocked over as disclosed in FIG. 3. More particularly, as best seen in FIG. 8*a*, each one of the guide rail members 50 is provided with a pair of upstanding mounting blocks 52 upon which a pair of slotted rail links 54 are mounted. Each one of the beam members 24 has a threaded bore, not shown, defined therein for respectively receiving a threaded shoulder bolt type fastener 56. Accordingly, as may readily be appreciated, when the bolt fasteners 56 are loosened, the slotted links 54, and the guide rail members 50 attached thereto, are able to be movably adjusted with respect to the beam members 24 so as to effectively adjust the transverse spatial disposition of the guide rail members 50 with respect to each other. In this manner, not only are differently sized traffic cones 12 able to be accommodated, but just as importantly, each one of the traffic cones 12 will be effectively transversely centered within the framework structure 20 so as to be properly engaged by the spear mechanism 42. Upon achieving the proper positional adjustment of the guide rail members 50 with respect to each other, the bolt fasteners 56 can then of course be tightened so as to secure the rail members 50 at their adjusted positions.

Figure 6A:
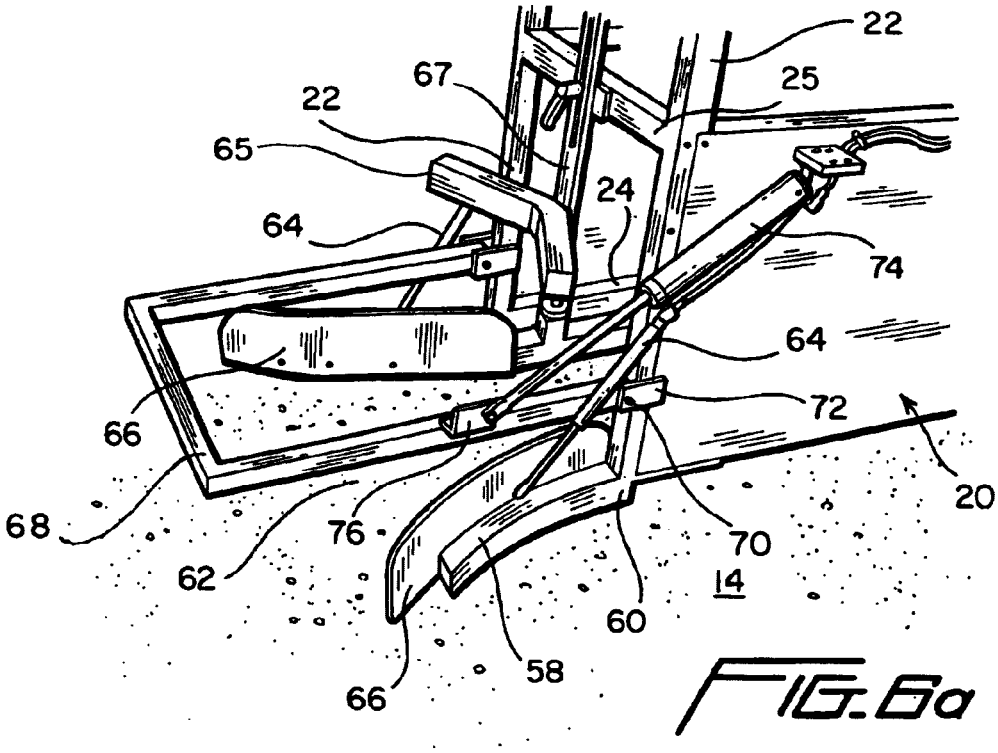
FIG. 6*a* is an enlarged, partial perspective view of the front end portion of the system or apparatus, as illustrated in FIG. 6, wherein a kicker mechanism is operatively mounted upon the front end portion of the system framework for vertically erecting a knocked-down traffic cone, when the apex and base portions of the traffic cone are not properly oriented with respect to the traffic cone spear mechanism, so as to permit the traffic cone to be knocked down in its proper orientation for proper engagement by the traffic cone spear mechanism in preparation for its stacking and nesting within the system framework.

With reference now being made to FIGS. 6 and 6*a*, it is further seen that an outwardly curved traffic cone entrance guide member 58 is pivotally mounted upon the forwardmost or free end portion of each one of the guide rail members 50 by means of suitable pivot pin structure 60 so that together the pair of traffic cone entrance guide members 58 operatively cooperate to define a divergent/convergent entrance mouth 62 into which each one of the upstanding traffic cones 12 can be guided as the roadwork vehicle or truck 18 and the auxiliary traffic cone retrieving system or apparatus 10 of the present invention are moved in the forward direction along the roadway surface 14 as may readily be appreciated from FIGS. 1 and 2. Shock absorbers 64 interconnect each one of the entrance guide members 58 to one of the forwardmost vertically oriented beam members 22 so as to effectively maintain the entrance guide members 58 at their appropriate disposition regardless of the fact that a particular one of the entrance guide members 58 may encounter a small obstruction upon the roadway surface 14. Wear pads 66 are preferably fixedly mounted upon the interior surface portions of the entrance guide members 58 so as to protect the same from wear which would otherwise occur as a result of the entrance guide members 58 repetitively encountering the traffic cones 12, and in this manner, the useful service life of the entrance guide members 58 can be extended so as not to require frequent maintenance, repair, or replacement.

In order to enable a particular traffic cone 12 to be retrieved and removed from the roadway surface 14 in accordance with the mode of operation of the system or apparatus 10 of the present invention as has been briefly alluded to hereinbefore in connection with the discussion of FIGS. 1–5, a horizontally disposed, transversely oriented knock-down bar 65 is fixedly mounted upon a vertically oriented mounting bracket 67 which is adjustably mounted upon a forwardmost one of the transversely oriented cross-beam members 25. Accordingly, when the roadwork truck or vehicle 18, and the attached system or apparatus 10 of the present invention, move in the forward direction relative to a particular one of the vertically upstanding traffic cones 12 such that the traffic cone 12 effectively enters the entrance mouth 62 defined between the entrance guide members 58 as shown in FIG. 2, the knock-down bar 65 will knock the traffic cone 12 down such that the traffic cone 12 is now disposed in its horizontal orientation as shown within FIG. 3 whereby the open base portion of the traffic cone 12 is disposed toward the interior of the framework structure 20 so as to be properly oriented for engagement and spearing by means of the spear mechanism 42. In the instance that a particular traffic cone has already been knocked down prior to being encountered by means of the system or apparatus 10 of the present invention, and still further, if the traffic cone is not properly oriented, that is, such that the open base portion thereof is disposed toward the interior of the framework structure 20, then the traffic cone 12 must be reoriented such that the traffic cone is in fact properly oriented for engagement and spearing by means of the spear mechanism 42.

Accordingly, a re-orientation kicker mechanism 68 is pivotally mounted upon the forwardmost transversely spaced vertically oriented beam members 22 by means of suitable pivot pin structure 70 and suitable brackets 72 as best seen in FIG. 6*a*. A dual-acting piston-cylinder mechanism 74, having its cylinder housing mounted upon the framework structure 20 and its piston rod operatively connected to the kicker mechanism 68 by means of suitable brackets 76, is used to move the kicker mechanism 68 between a normally raised disengaged or inoperative position, as illustrated within FIG. 6, and a lowered engaged or operative position as illustrated within FIG. 6*a*. As can be seen from FIGS. 6 and 6*a*, the kicker mechanism 68 comprises a three-sided open framework member and is used to vertically erect a traffic cone which is disposed in a horizontally knocked-down position wherein, however, the orientation of the traffic cone is reversed from the normally desired orientation as disclosed within FIG. 3, that is, the open base portion of the traffic cone 12 is not disposed toward the interior of the framework structure 20 so as not to be capable of being properly engaged and speared by means of the spearing mechanism 42.

Accordingly, when a roadwork operator or personnel workman, or the roadwork truck or vehicle driver, sees that a particular traffic cone is already disposed in its knocked-down but misoriented positional mode, the driver or operator can actuate the dual-acting piston-cylinder mechanism 74, by suitable control means not shown, so as to extend the piston rod member thereof as the system or apparatus 10 approaches the knocked-down traffic cone. As the kicker mechanism 68 is therefore lowered from its raised position to its lowered position by means of the piston-cylinder mechanism 74, the framework structure of the kicker mechanism 68 will impact the substantially upstanding base portion of the traffic cone thereby causing the previously knocked-down traffic cone to now assume a vertically upward orientation. Accordingly, as the system or apparatus 10 is moved further in the forward direction in accordance with further forward movement of the roadwork vehicle or truck 18, and relative to the newly erected traffic cone, the knockdown bar 65 will engage the upstanding traffic cone and knock the same down such that the traffic cone is now disposed in a proper horizontal orientation for further engagement and spearing by means of the spearing mechanism 42.

Figure 10:
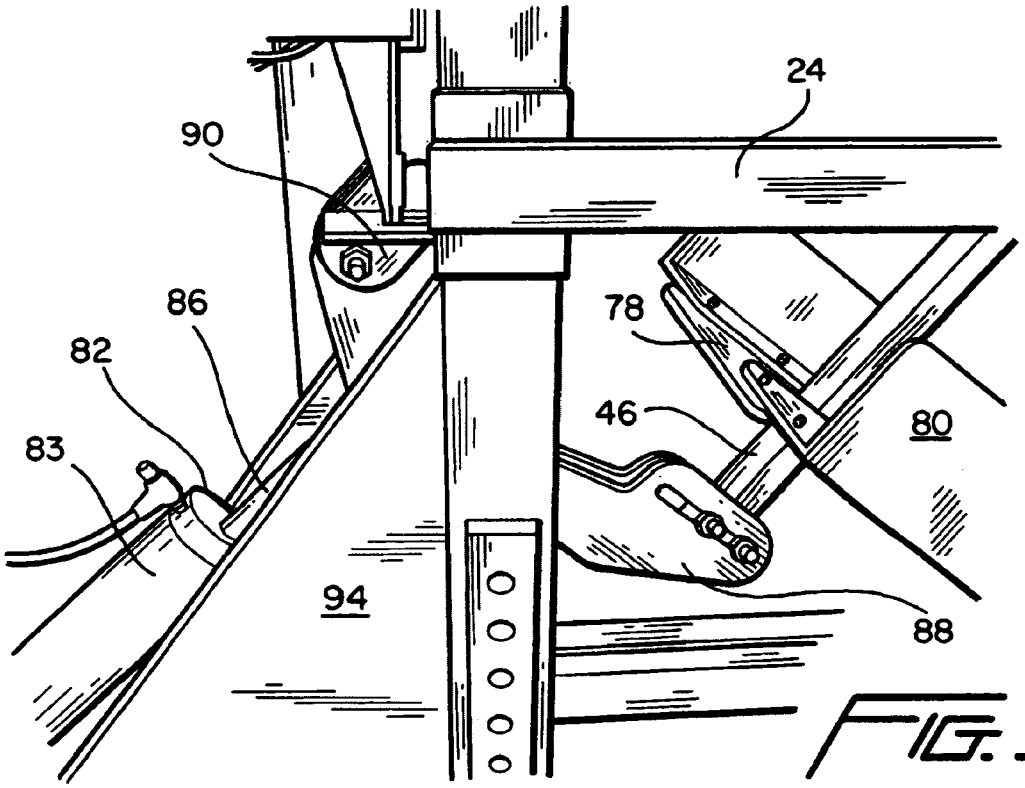
FIG. 10 is a side elevational view showing the first pneumatic actuating cylinder, as shown in FIG. 9, operatively connected to the traffic cone spear mechanism whereby the piston rod of the first actuating cylinder is shown partially extended such that the traffic cone spear mechanism is correspondingly disposed at a position intermediate its fully horizontal and fully vertical orientation positions.
Figure 11:
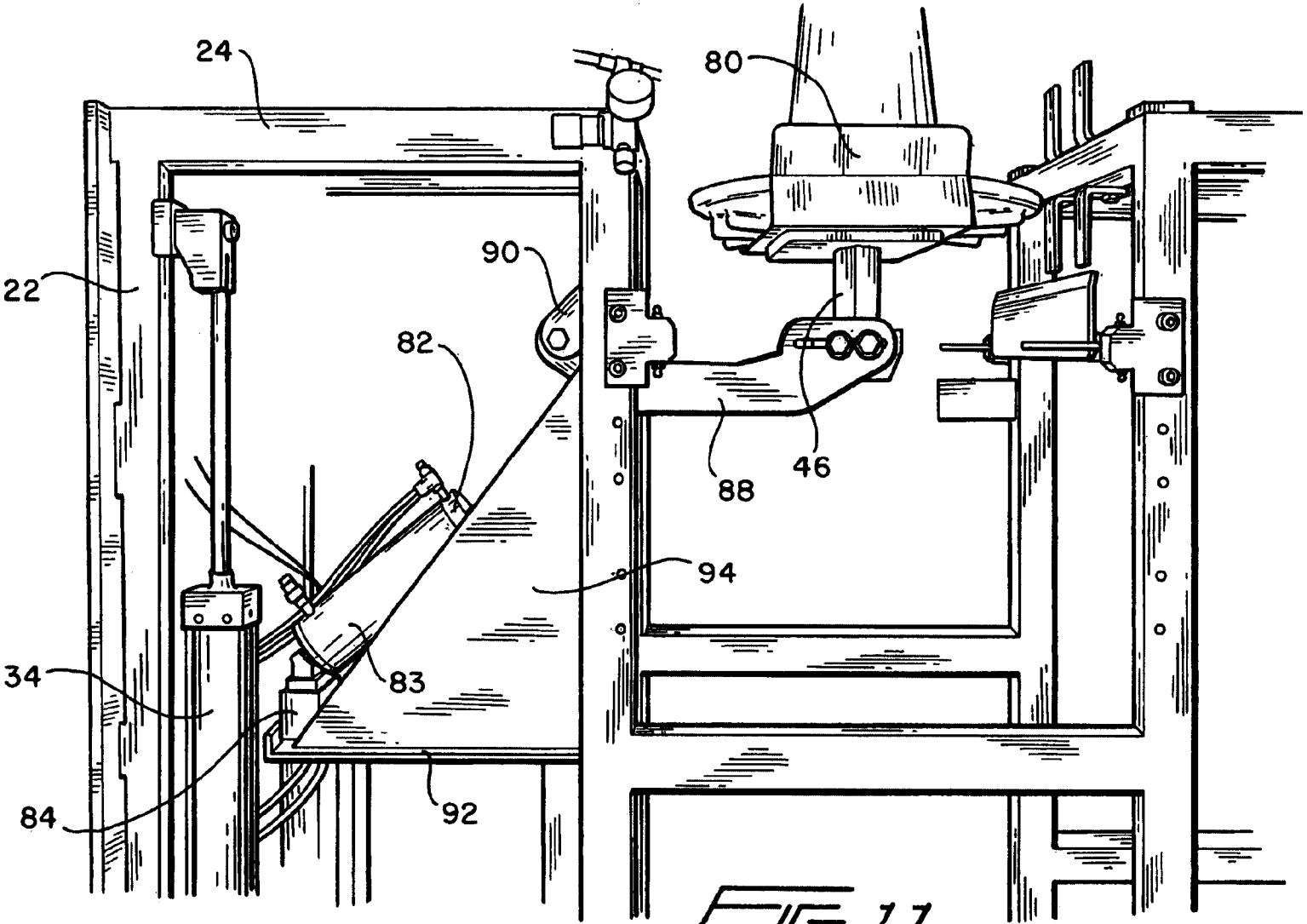
FIG. 11 is a side elevational view similar to that of FIG. 10 whereby the piston rod of the first actuating cylinder is shown fully extended such that the traffic cone spear mechanism is correspondingly disposed at its fully vertical orientation position.
Figure 12:
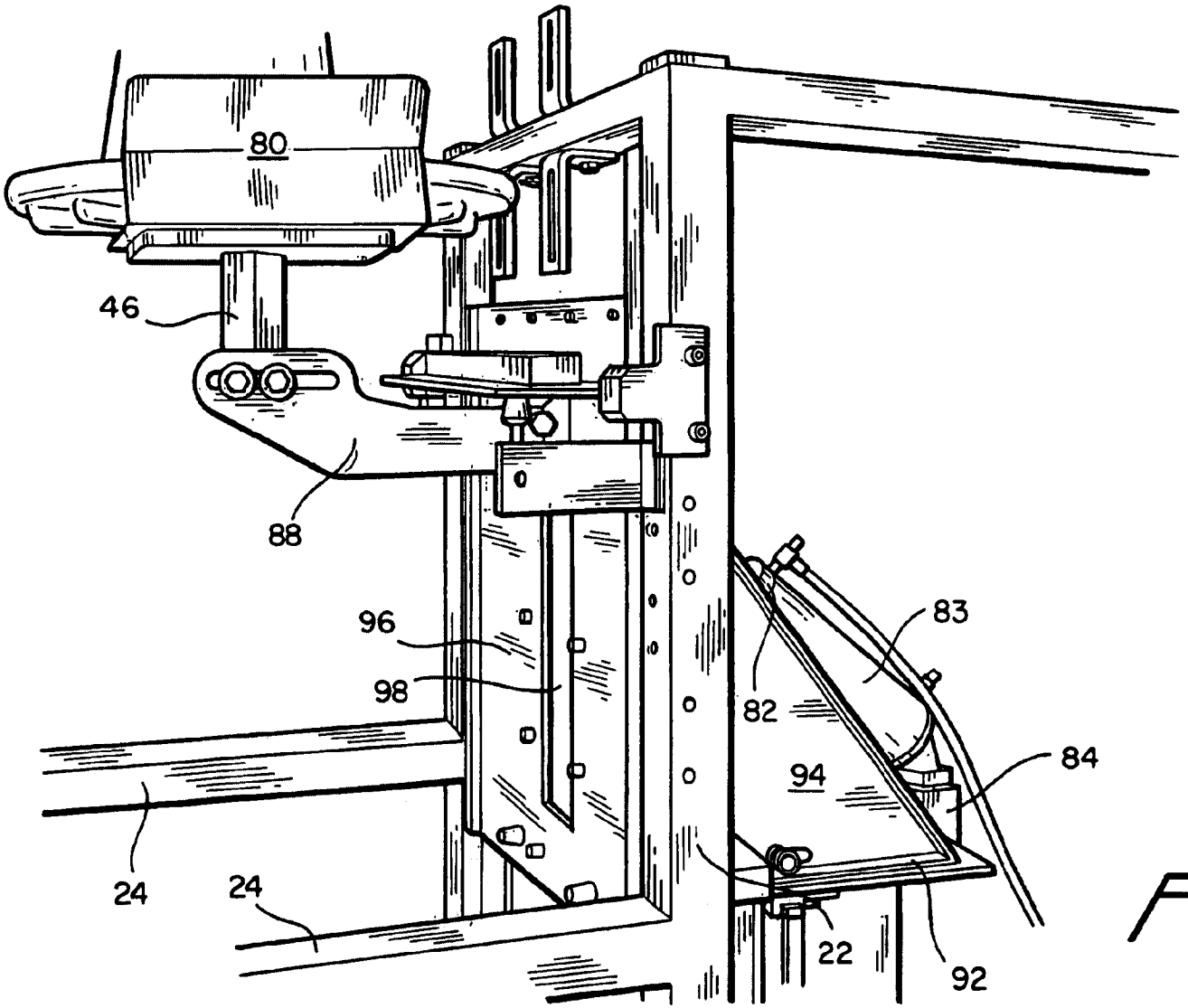
FIG. 12 is a side perspective view, similar to that of FIG. 11, showing the mounting of the first pneumatic actuating cylinder from a side viewpoint or perspective which is opposite to that of FIG. 11.
Figure 13:
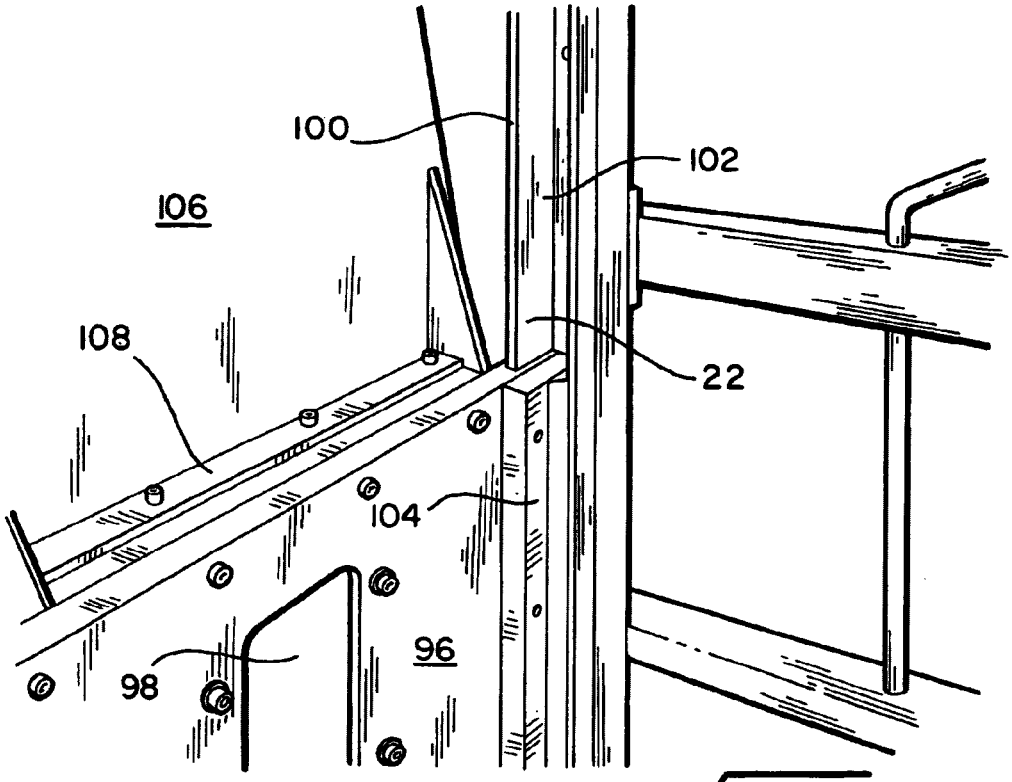
FIG. 13 is a perspective view showing the connection of a first pneumatic actuating cylinder mounting plate to a second pneumatic actuating cylinder mounting plate by means of which the entire traffic cone spear mechanism is able to be moved through pivotal and elevational modes.

With reference again being made to FIG. 8, the axially oriented mast member 46 of the spearing mechanism 42 has a cone support plate 78 fixedly mounted upon an intermediate section of the mast member 46 near the lower end portion thereof such that the lower end portion of the mast member 46 effectively passes through the support plate 78 and is disposed beneath the cone support plate 78 as may best be appreciated from FIGS. 10–12. A pair of substantially L-shaped cone guide fins 80 are fixedly mounted upon opposite sides of the cone support plate 78 so as to ensure that the base portion of the traffic cone is effectively guided onto the cone support plate 78 in an axially centered manner as the spearing mechanism 42 enters the hollow conical interior of one of the traffic cones 12 due to the fact that some lateral play may nevertheless be permissible between the traffic cone 12 and the spearing mechanism 42 during the early stage of insertion of the spearing mechanism 42 within the axially oriented hollow interior portion of the traffic cone 12. As can be appreciated still further from FIG. 3, for example, when the particular traffic cone 12 is disposed in its horizontal orientation upon the roadway surface 14 after being knocked down by means of the knockdown bar 65, the longitudinal axis of the traffic cone 12 will actually be inclined slightly downwardly as considered in the direction extending from the base portion of the traffic cone 12 to the apex portion of the traffic cone 12. Consequently, when the spearing mechanism 42 initially enters the hollow interior of the traffic cone 12 through the base portion thereof, the longitudinal axis of the horizontally disposed spearing mechanism 42 will be effectively misaligned in a non-coaxial manner with respect to the longitudinal axis of the traffic cone 12. The provision of the roller or wheel component 48 upon the forwardmost tip end portion of the spearing mechanism 42 therefore permits the spearing mechanism 42 to easily enter the hollow interior portion of the traffic cone 12 without encountering any significant resistance, whereby the traffic cone 12 will eventually be coaxially aligned upon the spearing mechanism 42 when the latter is fully inserted within the hollow interior portion of the traffic cone 12.

Figure 5:
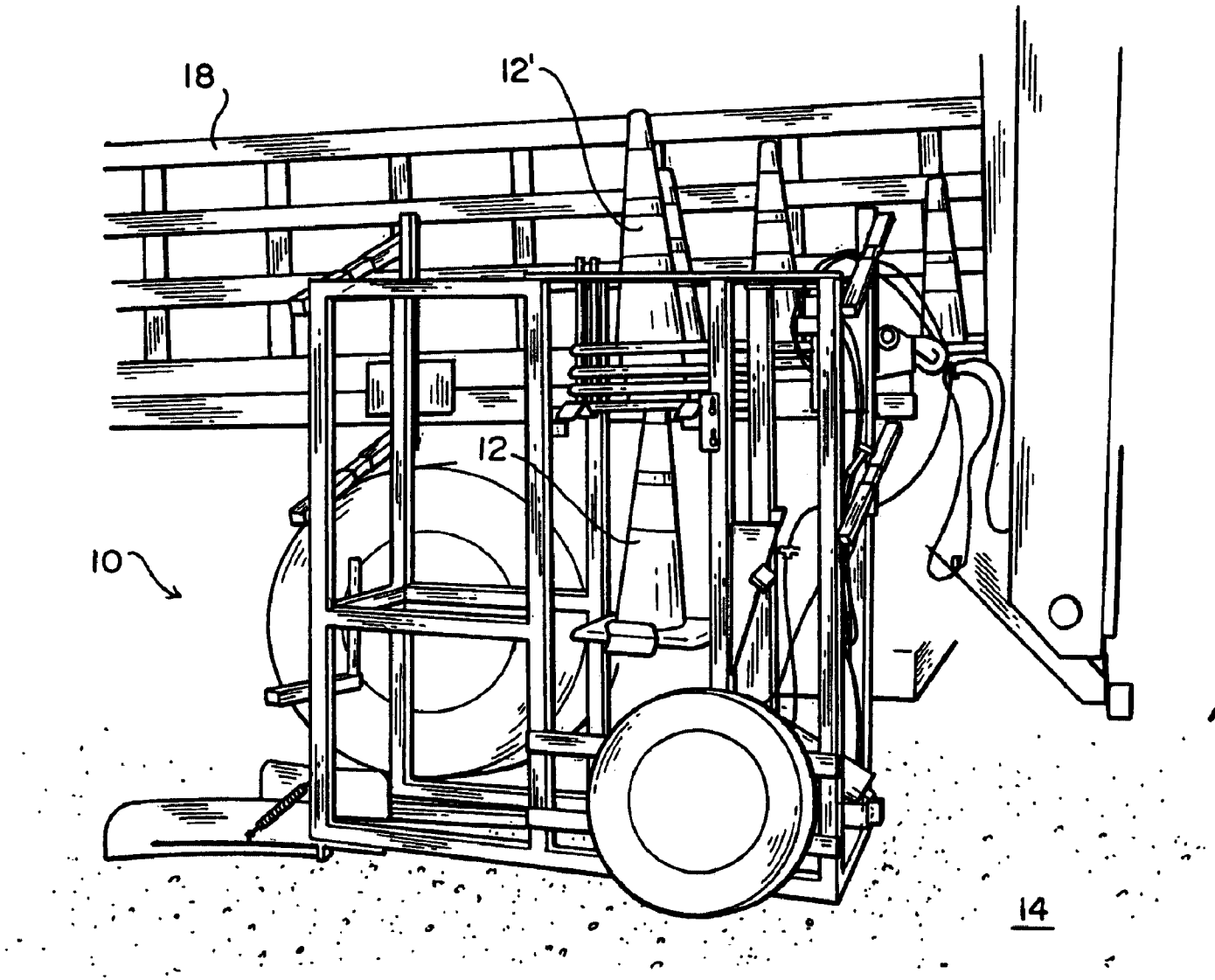
FIG. 5 is a perspective view similar to that of FIG. 2 showing, however, several traffic cones disposed in a nested and stacked array upon the fixed platform structure of the framework while an additional traffic cone is being elevated within the framework in preparation for being nested and stacked in conjunction with the traffic cones previously nested and stacked upon the fixed platform structure of the framework.
Figure 9:
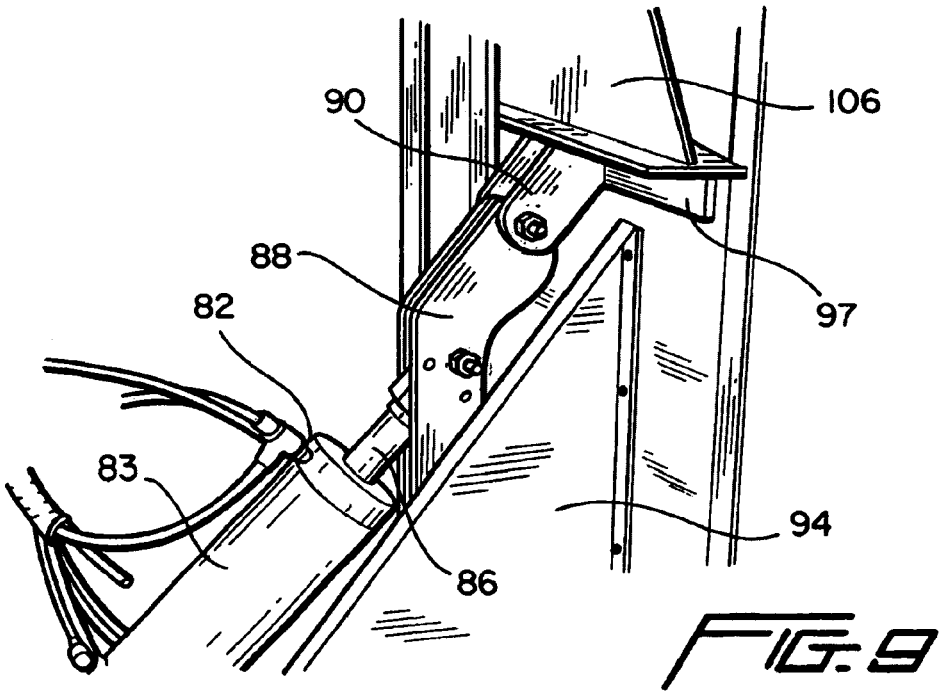
FIG. 9 is a side perspective view partially illustrating in detail the provision of the first pneumatic actuating cylinder operatively associated with the traffic cone spear mechanism shown in FIG. 8 for moving the traffic cone spear mechanism between its horizontally disposed orientation and its vertically disposed orientation, the first pneumatic actuating cylinder being illustrated with its piston rod at its fully retracted position corresponding to the horizontal orientation position of the traffic cone spear mechanism.

With reference now being made to FIGS. 9–14, the components for pivotally and elevationally actuating and moving the spearing mechanism 42 and the cone support plate 78 assembly, between the initial horizontally oriented spearing position shown in FIG. 8 and the vertically oriented position, such that the traffic cones 12 can be disposed in their stacked and nested mode as illustrated within FIGS. 4 and 5, will now be described. As can best be appreciated from FIGS. 10–12, a first piston-cylinder actuating assembly 82 for pivotally moving the spearing mechanism 42 and the cone support plate 78 assembly, between the initial horizontally oriented spearing position shown in FIG. 8 and the vertically oriented position shown in FIG. 4 prior to the stacking and nesting of the traffic cones 12 as shown in FIG. 5, has its cylinder housing 83 connected to a mounting block 84 while its piston rod 86 is pivotally connected to an intermediate portion of an actuating lever 88. A first end of the actuating lever 88 is pivotally mounted upon a mounting bracket 90, while a second opposite end of the actuating lever 88 is pivotally connected to the lower end portion of the mast member 46 of the spearing assembly 42. Accordingly, when the piston rod 86 of the piston-cylinder assembly 82 is disposed in its retracted position as shown in FIG. 9, the traffic cone spearing mechanism 42 is disposed in its horizontal orientation as shown in FIG. 8. When the piston rod 86 of the piston-cylinder assembly 82 is partially extended as shown in FIG. 10, it can be appreciated that the spearing assembly 42 is beginning to be pivotally moved from the horizontal disposition as shown in FIG. 8 toward the vertical orientation shown in FIG. 11, while when the piston rod 86 of the piston-cylinder assembly 82 is fully extended, the spearing assembly 42 is in fact pivotally moved to the vertical orientation shown in FIG. 11.

With reference still being made to FIGS. 9–14, the mounting block 84, upon which the cylinder housing 83 of the piston-cylinder assembly 82 is mounted, is itself fixedly mounted upon a support platform 92, and a pair of laterally or transversely spaced, vertically oriented triangularly-shaped brackets 94 fixedly connect the support platform 92 to a vertically oriented slide mechanism 96. The mounting bracket 90 is integrally fixed to an angle iron 97 which is fixedly mounted upon an upper rear surface portion of the slide mechanism 96, and the slide mechanism 96 is provided with a central, vertically oriented opening 98 through which the actuating lever 88 extends so as to operatively interconnect the first actuating piston-cylinder assembly 82, which is disposed rearwardly of the slide mechanism 96, to the traffic cone spearing mechanism 42 which is disposed forwardly of the slide mechanism 96. Central ones of the vertically upstanding framework beam members 22, as considered along the longitudinal extent of the framework structure 20 from the rear end thereof to the front end thereof, comprise substantially U-shaped channeled beams 100, as best seen within FIG. 13, whereby vertically oriented slide tracks 102 are defined therein. Opposite side edge portions of the slide mechanism 96 are provided with rail members 104 which are slidably disposed within the channeled beams 100 so as to permit or facilitate the vertically upward and downward slidable movement of the slide mechanism 96 within the channeled beams 100.

Figure 14:
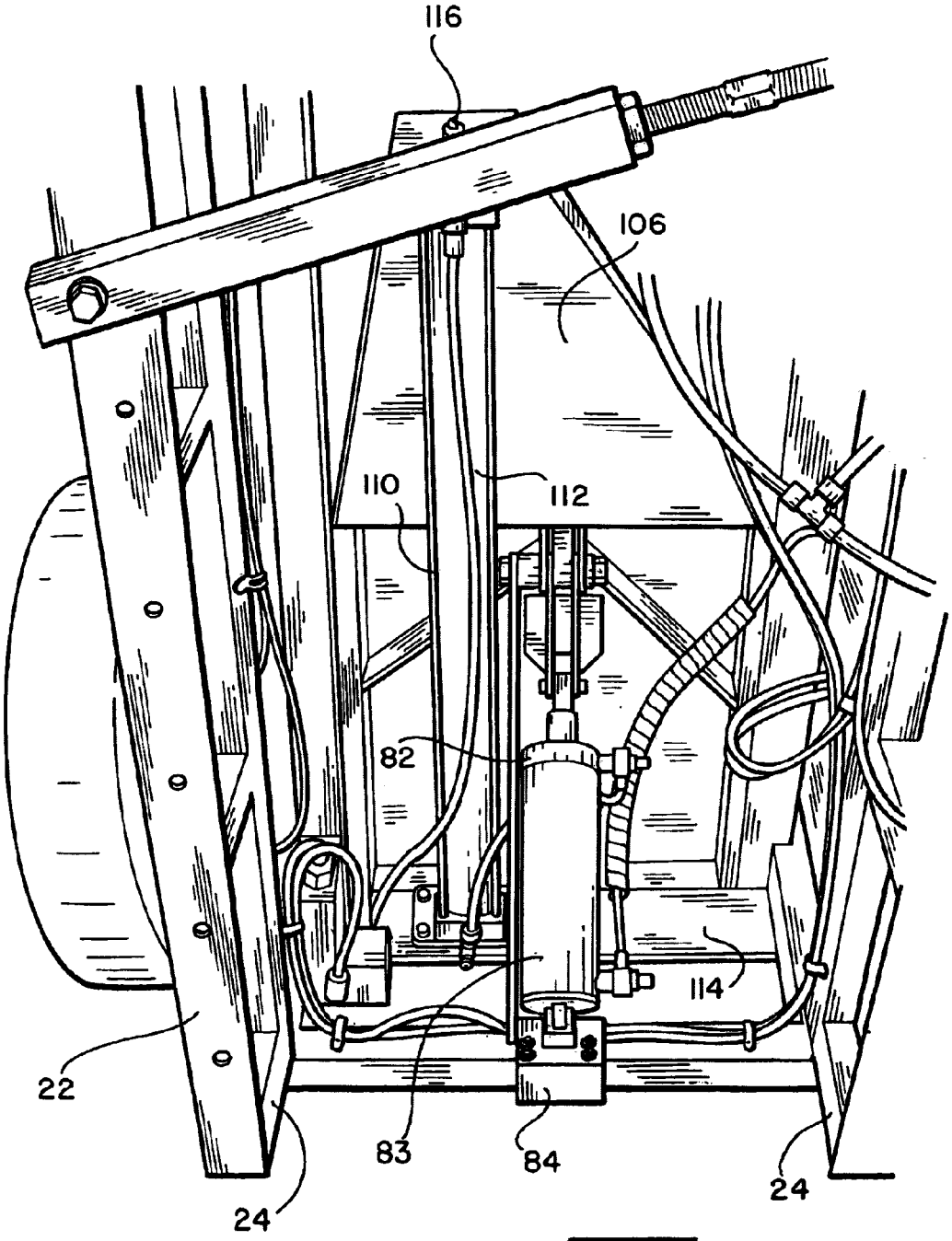
FIG. 14 is a rear elevation view showing the first and second pneumatic actuating cylinders as mounted upon the system framework.

Still further, a traffic cone elevating plate 106 has a lower flanged portion 108 thereof fixedly secured to the angle bracket 97, and as best seen in FIG. 14, a second piston-cylinder actuating assembly 110 is operatively connected to the elevating plate 106. In this manner, as the elevating plate 106 is moved vertically upwardly and downwardly, the traffic cone spearing mechanism 42 is likewise moved upwardly and downwardly through means of the various connections defined between the slide mechanism 96, the brackets 94, the support platform 92, the first piston-cylinder actuating assembly 82, and the lever arm 88, as has been described hereinbefore. As more particularly illustrated within FIG. 14, the second piston-cylinder actuating assembly 110 comprises a vertically oriented cylinder housing 112, and it is seen that the lower end portion of the cylinder housing 112 is fixedly mounted upon a transversely extending mounting plate 114 which is fixed at opposite sides thereof to lowermost longitudinally extending beam members 24 of the framework structure 20. The distal end of the piston rod of the second actuating piston-cylinder assembly 110 is illustrated at 116 and is seen to be fixedly connected to an upper end portion of the traffic cone elevating plate 106.

Figure 15:
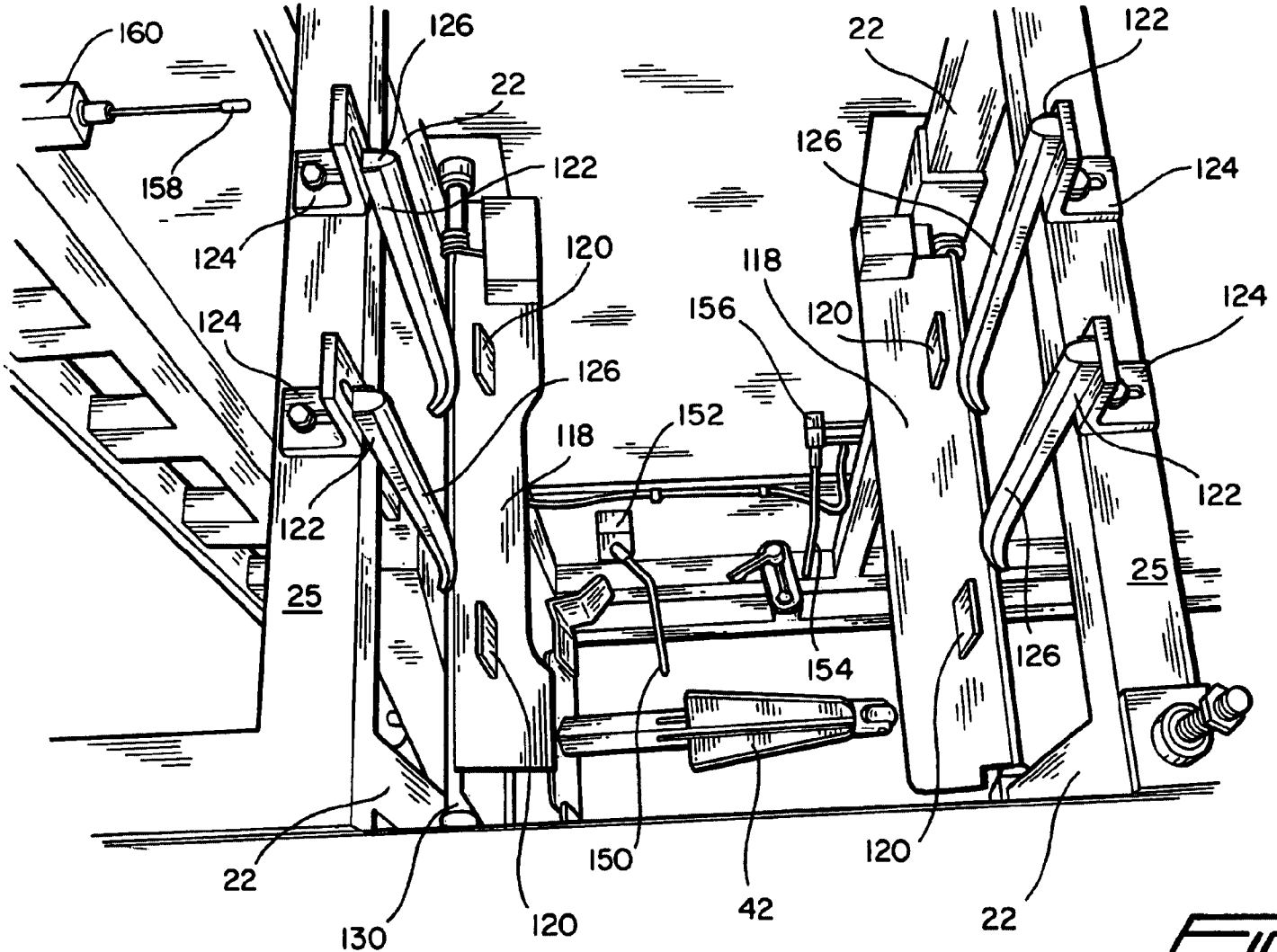
FIG. 15 is a top plan view showing the pivotal gate assemblies utilized for permitting a plurality of traffic cones to be stacked or nested in a supported mode within the system framework when the gate components are disposed at their lowered positions as illustrated.

After a particular traffic cone 12 has been engaged and speared by means of the spearing mechanism 42, and after the first and second piston-cylinder actuating assemblies 82,110 have respectively moved the spearing mechanism 42, and the particular traffic cone 12 disposed thereon, from their horizontal orientations to their vertical orientations, and have subsequently begun to elevate the spearing mechanism 42 so as to move the traffic cone 12 carried thereon to an elevated position at which the traffic cone 12 can be stacked and nested along with other traffic cones 12' as shown in FIGS. 4 and 5, structure must be provided for attaining the supported stacking and nesting of the plurality of traffic cones 12'. With reference therefore now being made to FIGS. 15–17, the unique structure, constructed in accordance with the principles and teachings of the system or apparatus 10 of the present invention, for attaining the supported stacking and nesting of the plurality of traffic cones 12', will now be described. More particularly, a pair of longitudinally spaced, transversely extending gate members 118 are pivotally mounted upon laterally opposite vertically upstanding beam members 22, each one of the gate members 118 comprising, in effect, an angle iron structure. As shown in FIG. 15, the gate members 118 are normally disposed in their pivotally lowered horizontal positions at which the gate members 118,118 together cooperate to define a support structure upon which a single traffic cone 12' can be supported as shown in FIG. 4, or upon which a nested stack of traffic cones 12' can be supported as shown in FIG. 5.

Each one of the gate members 118 has a pair of laterally or transversely spaced upstanding tab members 120 fixedly secured to an upper surface portion thereof so as to effectively confine the substantially square base portion of a traffic cone 12' therebetween when the traffic cone 12' is disposed upon the gate members 118,118. In addition, it is seen that a pair of vertically oriented guide members 122 are fixedly mounted upon oppositely disposed, uppermost cross-beam members 25 through means of respective angle brackets 124 so as to likewise effectively confine the nested stack of traffic cones 12' as the nested stack of traffic cones 12' is being elevated so as to accommodate a newly elevated traffic cone 12 which is to become the lowermost one of the traffic cones 12' comprising the nested stack of traffic cones 12'. Each one of the guide members 122 has a channel structure within which a suitable friction-reducing member 126 is disposed so as to facilitate the vertical elevation of the nested stack of traffic cones 12' during the insertion of a new traffic cone 12 into the nested stack of traffic cones 12'. The friction-reducing members 126 may comprise any suitable material, such as, for example, NYLON®, DELRIN®, which are readily commercially available.

Figure 17:
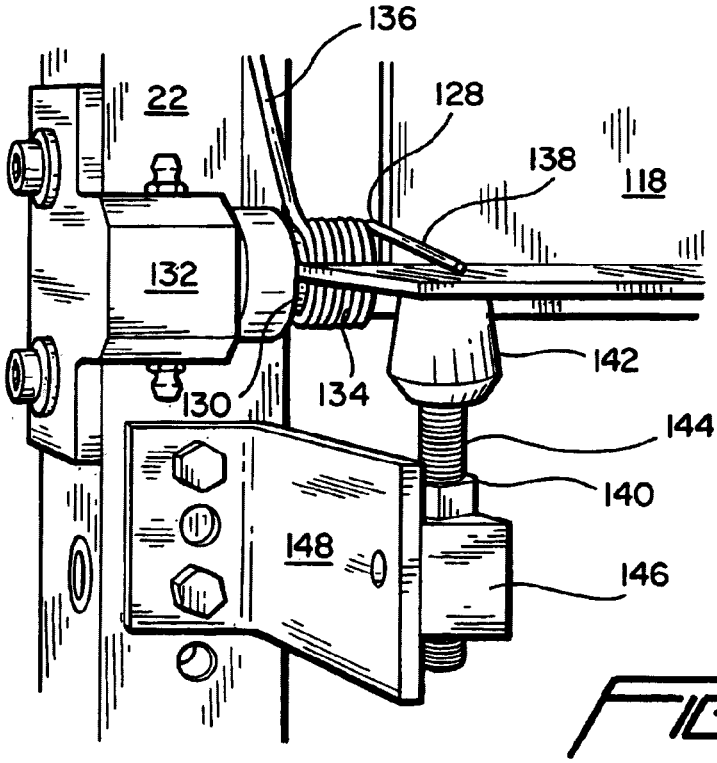
FIG. 17 is an enlarged detailed view showing one of the adjustable stop members operatively associated with each one of the gate components for limiting or defining the pivotally lowered position for each gate component.
Figure 16:
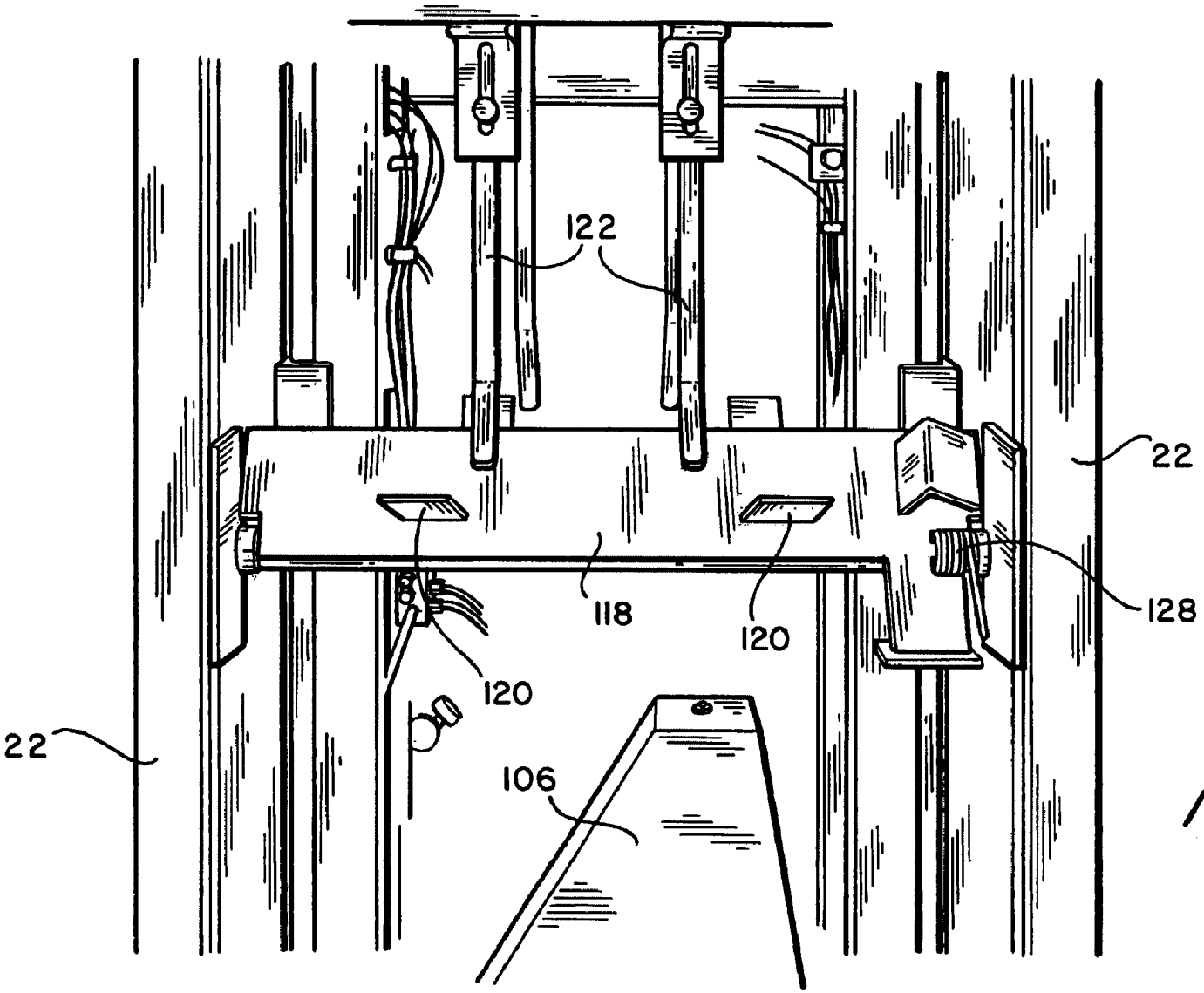
FIG. 16 is a side elevational view showing one of the gate components, as illustrated in FIG. 15, moved to its pivotally raised position so as to permit successive ones of the traffic cones to be nested and stacked.

As shown in FIGS. 16 and 17, the gate members 118 are spring-biased by means of coil spring assemblies 128 disposed at each end of each gate member 118 such that the gate members 118 are normally dis-posed at their pivotally lowered positions as shown in FIGS. 15 and 17, however, the gate members 118 may be pivotally moved to upstanding positions as shown in FIG. 16 when encountered by means of a traffic cone 12 being elevated by the spearing mechanism 42 so as to permit the elevated traffic cone 12 to effectively bypass the gate members 118 in order to form a part of the nested stack of traffic cones 12'. After the traffic cones 12' have bypassed the gate members 118, the coil spring assemblies 128 will return to the gate members 118 to their normally lowered positions such that the gate members 118,118 will together be capable of supporting the nested stack of traffic cones 12' as shown in FIG. 5. A preferred mounting of each one of the gate members 118 upon the framework structure 20 is illustrated in detail in FIG. 17. More particularly, as can also be seen from FIG. 15, each one of the gate members 118 is adapted to be welded to a transversely extending rod member 130, and opposite ends of the rod members 130 are adapted to be pivotally mounted within suitable mounting blocks 132 which are fixedly mounted upon particular ones of the vertically oriented beam members 22 of the framework structure 20. Each one of the coil spring assemblies 128 is seen to comprise a coiled hub section 134 which is disposed around a portion of each rod member 130, and a pair of spring arms 136,138 extend outwardly from opposite ends of the coiled hub section 134. A first one of the spring arms 136 is adapted to be operatively engaged in contact with the upstanding beam member 22, while the second one of the spring arms 138 is adapted to be operatively engaged in contact with the gate member 118 such that the gate 118 is normally biased toward its pivotally lowered position. In order to actually define the lowered position of each gate member 118, and to additionally support the same at its lowered position, a stopper assembly 140 is also mounted upon each one of the vertically oriented beam members 22. More particularly, as can be seen from FIG. 17, a rubber stopper 142 is mounted atop a threaded rod 144, and the threaded rod 144 is adapted to be threadedly engaged within an internally threaded bore of a mounting block 146. The mounting block 146 is welded to an angle iron mounting bracket 148, and the mounting bracket 148 is, in turn, welded upon the vertically oriented beam member 22. Threaded adjustment of the rod member 144 within the mounting block 146 permits the rubber stopper 142 to be disposed at a predeterminedly desired elevational level so as to properly support the gate member 118 at its lowered, traffic cone supporting position.

In light of the foregoing description of the various structural components comprising the new and improved traffic cone retrieving apparatus or system 10 of the present invention, a brief operation of the system or apparatus will now be described. As the roadwork truck or vehicle 18 moves forwardly such that the apparatus 10 of the present invention approaches a traffic cone 12 to be retrieved and removed from the roadway surface 14 as shown in FIG. 1, the erect traffic cone 12 will enter the entrance mouth 62 defined between the entrance guide members 58 as shown in FIG. 2 and will be knocked down by means of the knock-down bar 65 as shown in FIG. 3. The knocked-down traffic cone 12 will then enter the interior of the framework structure 20 as a result of being guided therein by means of rail members 50,50, as shown in FIGS. 8 and 15, whereupon the spearing mechanism 42 can enter the hollow interior of the knocked-down traffic cone 12. As the spearing mechanism 42 moves relatively forwardly, and concomitantly therewith, the traffic cone 12 effectively moves relatively rearwardly, the base portion of the traffic cone 12 will encounter a feeler rod 150 of a first limit switch mechanism 152 which is operatively mounted upon a lower sidewall portion of the framework structure 20. As the traffic cone 12 becomes fully engaged by means of the spearing mechanism 42 and is seated upon the cone support 78, the engagement and actuation of the limit switch mechanism 152 will cause activation of the first piston-cylinder actuating assembly 82 whereby the first piston-cylinder actuating assembly 82 will cause the spearing mechanism 42 to be pivotally moved from the horizontal mode disclosed within FIGS. 8 and 15 toward the vertical mode as disclosed within FIG. 10. At the same time, if the traffic cone re-orientation kicker mechanism 68 was initially activated, actuation of the first limit switch mechanism 152 will likewise initiate upward retraction of the kicker mechanism 68 to its normal operatively disengaged position.

As the spearing mechanism 42, and the traffic cone 12 now carried thereby, move through its intermediate position as shown in FIG. 10 to its vertical position as shown in FIG. 11, a side portion of the traffic cone 12 will encounter a feeler rod 154 of a second limit switch mechanism 156 which is also operatively mounted upon a sidewall portion of the framework structure 20 above that of the first limit switch mechanism 152. Accordingly, as the spearing mechanism 42 reaches its vertical orientation as disclosed within FIG. 11, the engagement and actuation of the limit switch mechanism 156 by the traffic cone 12 will cause activation of the second piston-cylinder actuating assembly 110 such that the spearing mechansim 42 and the traffic cone 12 carried thereby will now begin to be elevated as shown in FIG. 4.

As the spearing mechanism 42 and the traffic cone 12 carried thereby are elevated, the spearing mechanism 42 can pass between the gate members 118,118, however, outer edge portions of the base section of the traffic cone will encounter the gate members 118,118 thereby causing the gate members 118,118 to be pivoted upwardly against the spring bias of the coil spring assemblies 128,128. The traffic cone 12 will therefore now be disposed above the gate members 118,118, the gate members 118,118 will pivot downwardly to their original positions under the influence of the biasing forces of the coil spring assemblies 128,128, and as can be appreciated from FIG. 15, a structural component, not shown, of the elevating plate 106 will be positioned so as to encounter a feeler member 158 of a third limit switch mechanism 160 whereby further upward movement of the spearing mechanism 42 and the traffic cone 12 carried thereby will be terminated. The actuation of the second piston-cylinder actuating assembly 110 will now be reversed, the spearing mechanism 42 will effectively be lowered and will pass between the gate members 118,118, however, the traffic cone 12' will now be deposited and seated upon the lowered gate members 118,118 so as to form part of the nested stack of traffic cones as shown in FIG. 5. When the second piston-cylinder actuating assembly 110 fully lowers the spearing mechanism 42, the first piston-cylinder actuating assembly 82 is retracted so as to return the spearing mechanism 42 to its horizontal mode, and the system or apparatus 10 is readied for a new traffic cone retrieving operation. It is to be noted that all of the electrical limit switches, and all of the pneumatic control valves, not shown, operatively associated with the pneumatic actuating piston-cylinder assemblies, of the system or apparatus 10 are adapted to be controlled by means of a suitable on-board program logic controller (PLC) 162, known in the art, which is schematically illustrated in FIG. 6.

Figure 18:
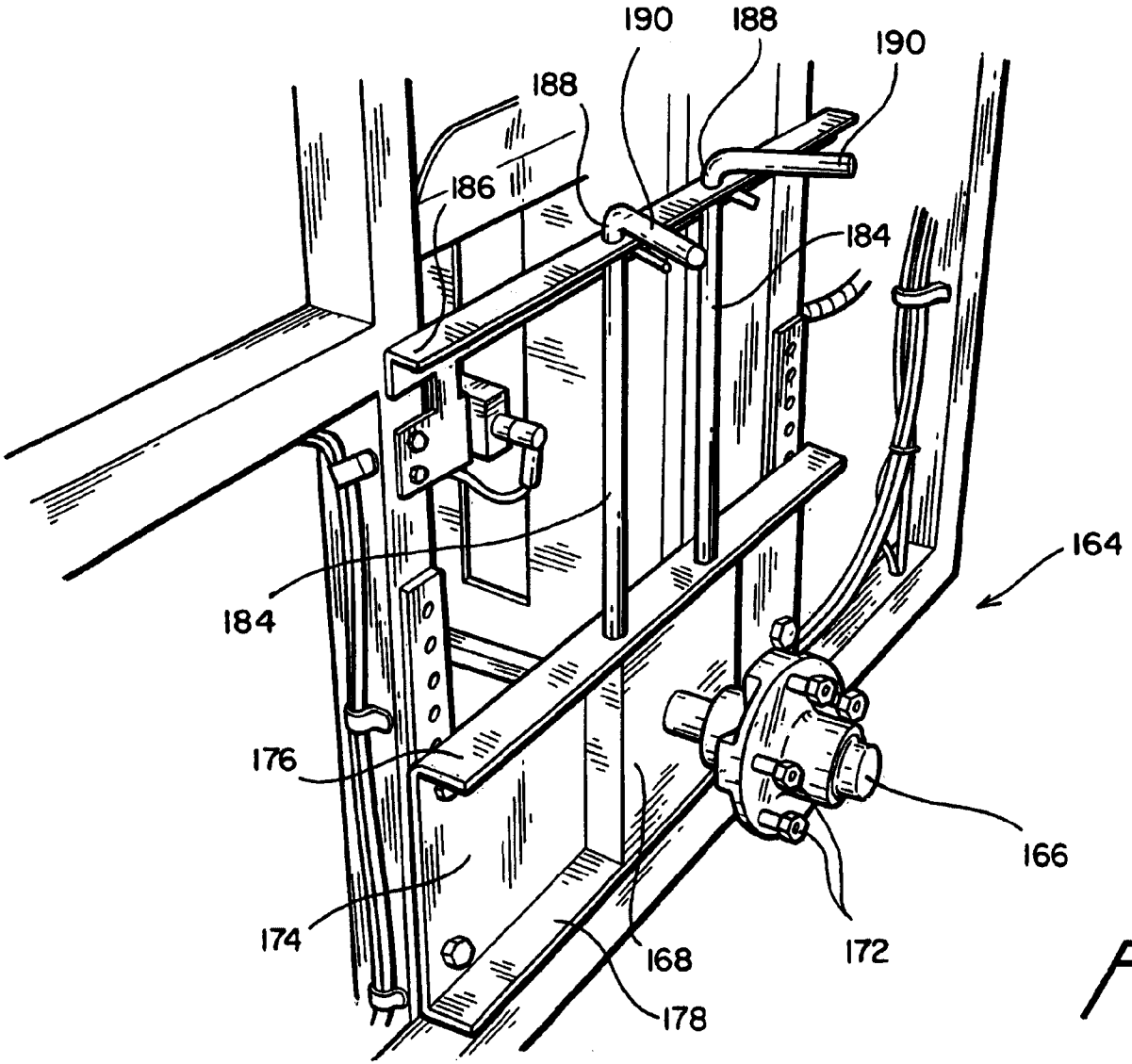
FIG. 18 is a perspective view showing the wheel mounting assembly for mounting the framework support wheel upon either side of the system framework.
Figure 19:
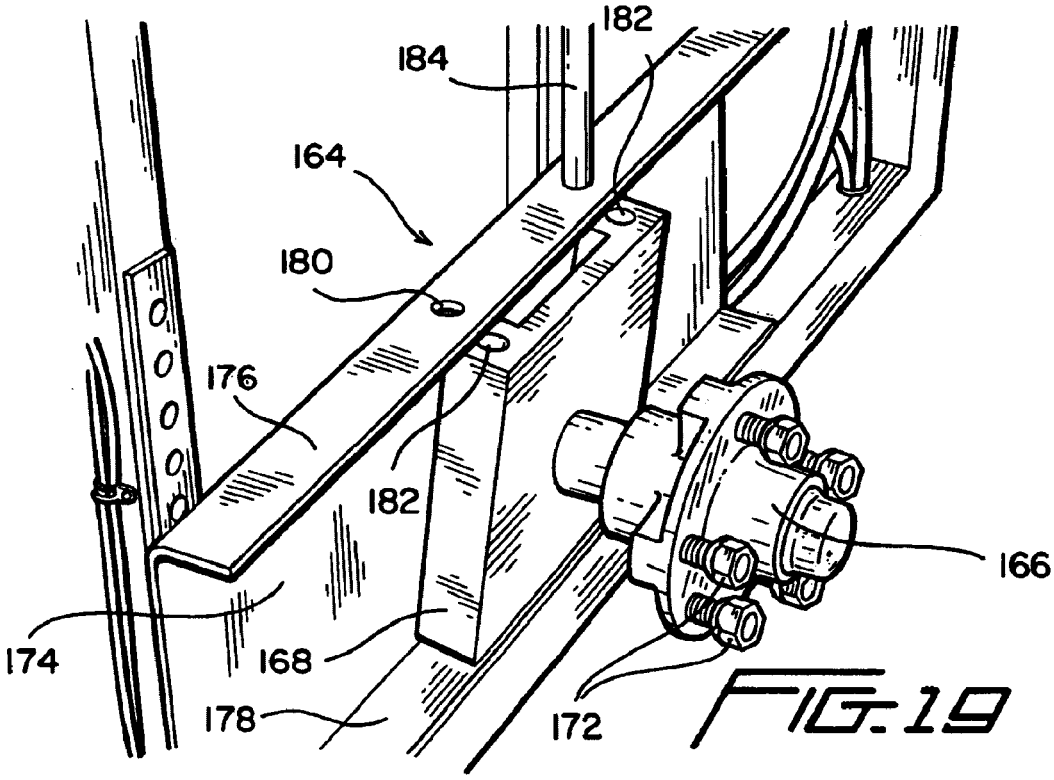
FIG. 19 is an enlarged perspective detail view of the wheel mounting assembly illustrated within FIG. 18.

With reference now being made to FIGS. 18 and 19, a first embodiment of a mounting system 164 for a single wheel assembly, such as that disclosed at 32, is disclosed. In view of the fact that the system or apparatus 10 of the present invention is adapted to be used upon either side of the roadway truck or vehicle 18, the wheel mounting system 164 must accordingly be adapted for mounting the wheel assembly 32 upon either side of the vehicle 18. As is therefore illustrated within FIGS. 18 and 19, the wheel assembly 32 comprises a rotary hub 166 which is rotatably mounted within a mounting block 168, and the vehicle wheel 170 is adapted to be fixedly mounted upon the rotary hub 166 by means of a plurality of threaded studs or bolts 172. A substantially C-shaped mounting channel 174 is fixedly mounted upon each side of the framework structure 20, and the upper and lower flange portions 176,178 of the C-shaped mounting channel 174 are respectively provided with a pair of longitudinally spaced apertures 180, only those apertures 180 defined within the upper flange portion 176 being visible, however, as shown in FIG. 19. In a similar manner, the mounting block 168 is provided with a pair of longitudinally spaced through-bores 182, and when a pair of vertically disposed fixation rods 184 are removably passed through the apertures 180 defined within the upper and lower flange portions 176,178 of the mounting channel 174, as well as being passed through the through-bores 182 defined within mounting block 168, the mounting block 168, and the wheel hub 166 and vehicle wheel 170 mounted thereon, will be fixedly mounted upon the framework structure 20 of the apparatus or system 10.

As best seen in FIG. 18, in order to mount the fixation rods 184 upon the framework structure 20 in a stabilized but removable manner, an angle iron mounting bracket 186 is also mounted upon the framework structure 20 at an elevational level which is above that of the mounting channel 174. In a manner similar that of the flange portions 176,178 of the mounting channel 174, the horizontal flange portion of the mounting bracket 186 is also provided with a pair of longitudinally spaced apertures 188 through which upper end portions of the fixation rods 184 extend. The uppermost end portions 190 of the fixation rods 184 extend horizontally outwardly such that the fixation rods 184 have substantially inverted L-shaped configurations, and consequently, when the horizontally disposed end portions 190 are seated upon the horizontal flange portion of the mounting bracket 186, the entire wheel mounting system 164 is stably mounted upon the framework structure 20. In order to readily mount the wheel assembly 32 upon either side of the system or apparatus 10, the fixation rods 184 need only be removed or withdrawn vertically upwardly from their disposition within one of the lower mounting channels 174 disposed upon a particular side of the system or apparatus 10 thereby releasing the mounting block 168 with the wheel hub 166 and wheel 170 mounted thereon. The latter components can then be re-assembled or re-mounted upon the opposite side of the apparatus or system 10 by simply inserting the mounting block 168 within a similar mounting channel 174 and securing the mounting block 168 within the mounting channel 174 by means of a similar pair of fixation rods 184,184.

Figure 20:
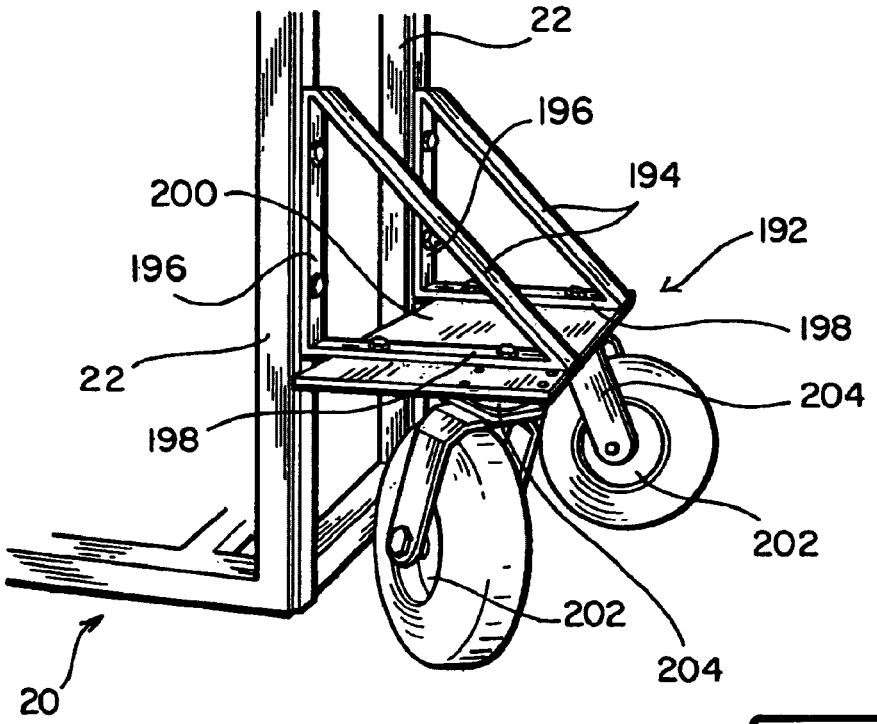
FIG. 20 is a perspective view of a second embodiment of a rear wheel mounting assembly rollably supporting the apparatus or system of the present invention upon the roadway surface.

With reference now being made to FIG. 20, in lieu of the single wheel assembly 32 for the system or apparatus 10 of the present invention as disclosed within FIG. 6, the system or apparatus 10 may be provided with an alternative wheel assembly 192. More particularly, a pair of substantially right-triangularly-shaped angle brackets 194 are fixedly mounted upon the pair of rearmost vertically oriented beam members 22 of the framework structure 20 such that a first upstanding leg member 196 of each right-triangle configured bracket 194 is, for example, bolted to one of the beam members 22, while the second horizontally oriented leg member 198 of each bracket 194 projects rearwardly from the framework structure 20. A wheel-mounting platform or plate 200 is bolted to the undersurface portions of the horizontal leg members 198 of the brackets 194, and in turn, a pair of wheel assemblies 202 are adapted to be mounted upon undersurface portions of the platform or plate 200 through means of rotatable caster assemblies 204. In this manner, as can readily be appreciated as a result of a comparison between the wheel assembly 192 of FIG. 20 and the wheel assembly of FIG. 6, the mounting of the road-engaging wheel assemblies upon the framework structure 20 of the present invention has been substantially simplified in that regardless of which side of the roadwork truck or vehicle that the apparatus of system 10 of the present invention is mounted upon, the wheel assembly 192 need not be removed from one outer side region of the framework structure 20 and remounted upon the other opposite outer side region of the framework structure 20.

Figure 23:
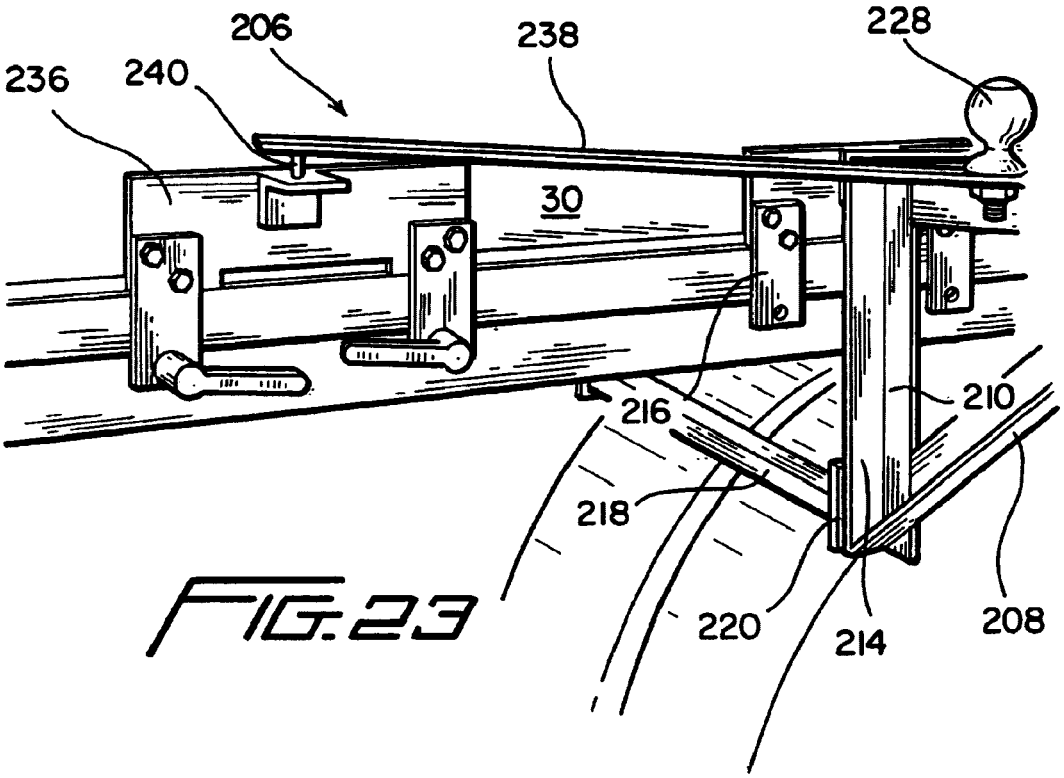
FIG. 23 is a side perspective view showing the bracing bar component of the mounting bracket system as disclosed within FIG. 22.
Figure 24:
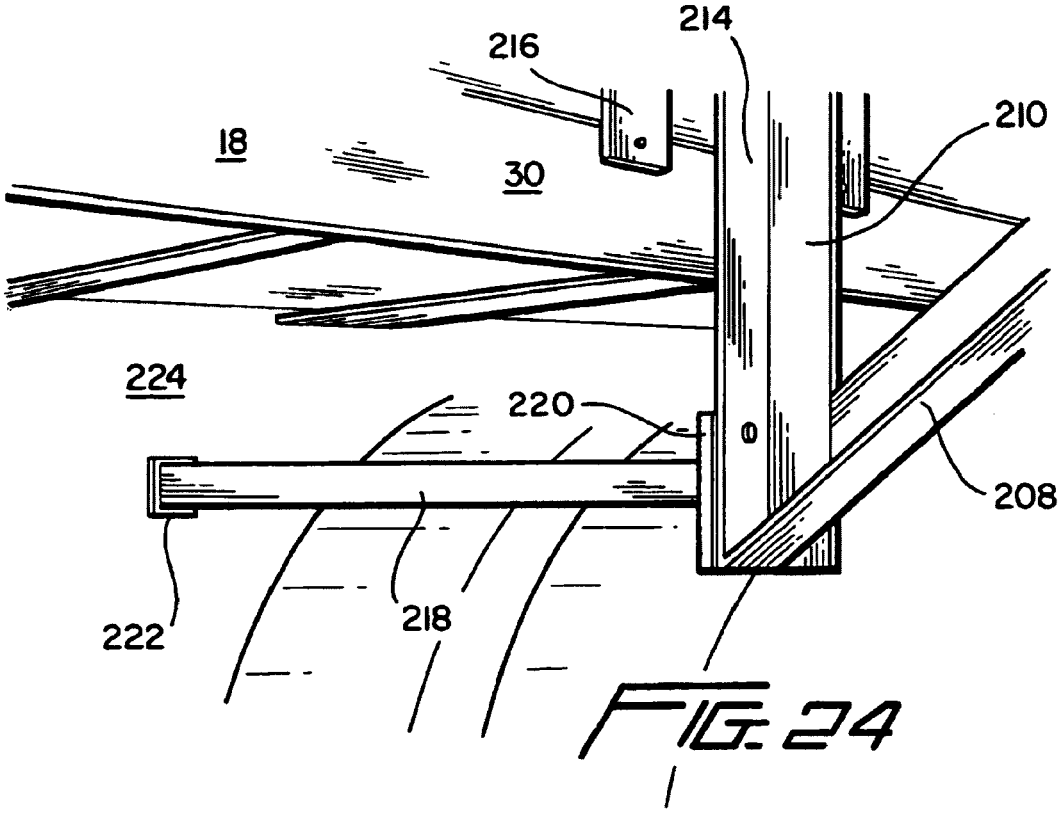
FIG. 24 is a perspective view showing a footed bracing shaft component connected to the lower end portion of the mounting bracket and engaging an undercarriage portion of the roadwork truck or vehicle.
Figure 25:
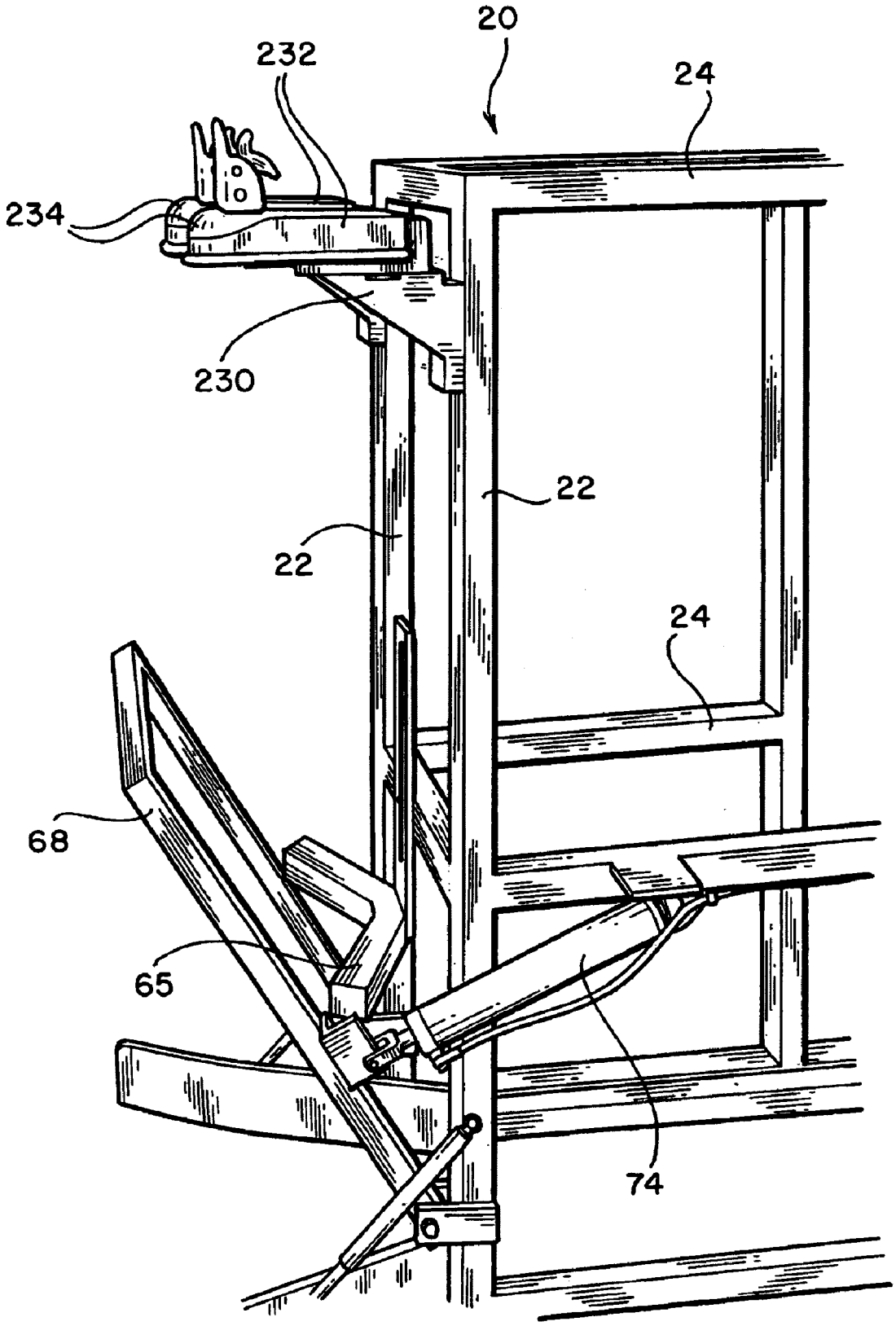
FIG. 25 is a side elevational view of the system or apparatus of the present invention disclosing a second mounting bracket having female hitch socket members integrally mounted thereon for operative mating with the first mounting bracket as disclosed within FIGS. 21 and 22.

With reference lastly being made to FIGS. 21–25, as was the case with the wheel assembly 192 illustrated in FIG. 20 comprising a simplified system with respect to the wheel assembly 32 illustrated within FIG. 6, a simplified structural arrangement for mounting the entire system or apparatus 10 of the present invention upon the roadwork truck or vehicle 18, in lieu of the system comprising, for example, the turnbuckle assemblies 26 shown in FIG. 6, and the floating cylinder assemblies 34 shown in FIG. 7, is illustrated at 206. More particularly, the structural arrangement 206 comprises a right-triangularly configured support bracket 208 having the vertical leg member 210 thereof oriented downwardly, and the horizontal leg member 212 thereof projecting outwardly from the outer side region of the roadwork truck or vehicle 18. As can best be appreciated from FIGS. 21 and 23, the vertical leg member 210 has a transversely oriented mounting plate 214 integrally connected thereto at the upper end thereof wherein the mounting plate 214 extends transversely beyond the opposite side surfaces thereof such that, in turn, a transversely oriented mounting bracket 216 can be fixedly mounted thereon so as to likewise extend transversely beyond the opposite sides thereof, the mounting bracket 216 being adapted to be bolted to the side rail portion 30 of the roadwork vehicle or truck 18. A leg brace 218 has a proximal end foot portion 220 thereof bolted to the lower end portion of the mounting plate 214, while the distal free end foot portion 222 of the leg brace 218 is adapted to engage an undercarriage portion 224 of the roadwork truck or vehicle 18 as best seen in FIG. 24.

Figure 21:
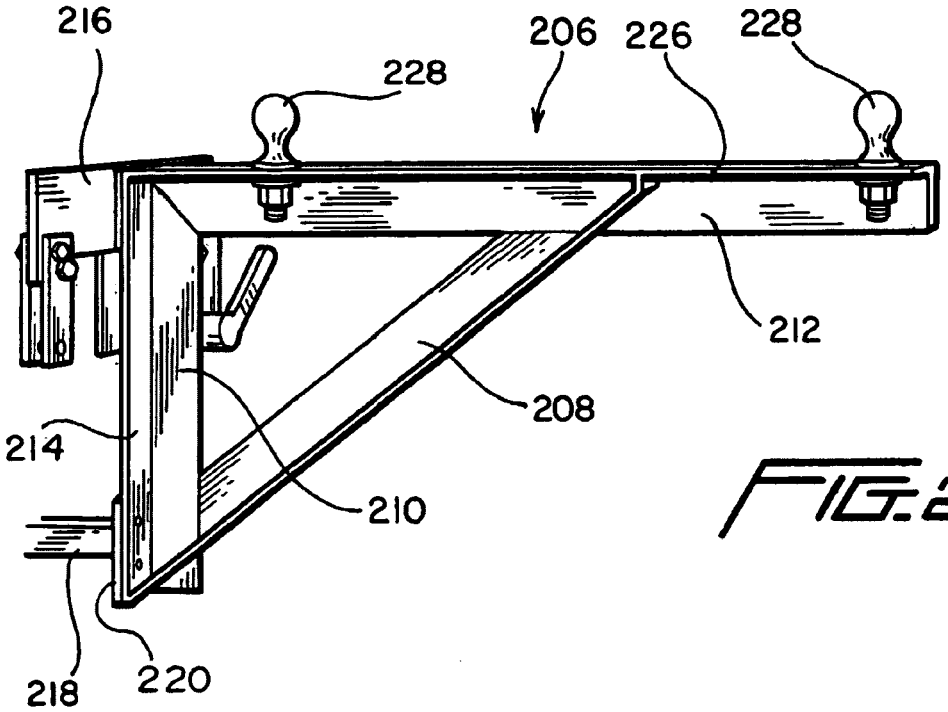
FIG. 21 is a front elevational view of a first mounting bracket having male hitch members integrally mounted thereon for operative connection to the framework structure of the system or apparatus of the present invention so as to operatively mount the system or apparatus upon a side portion of the roadwork truck or vehicle.
Figure 22:
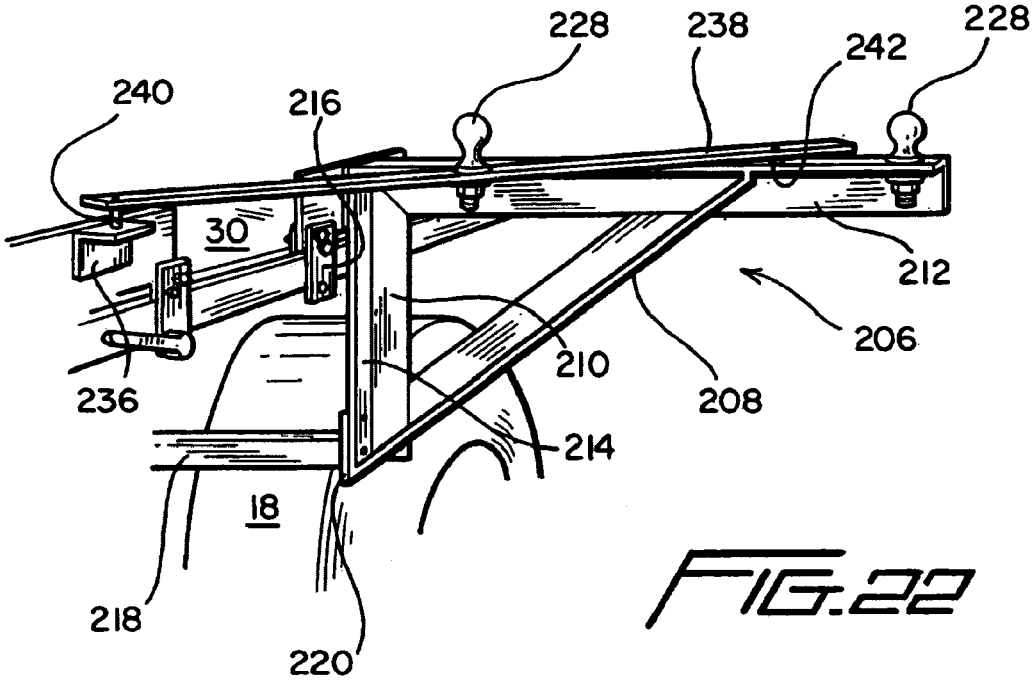
FIG. 22 is a front perspective view showing the mounting bracket of FIG. 21 as mounted upon a side portion of the roadwork truck or vehicle.

As can best be appreciated from FIG. 21, the horizontal leg member 212 of the support bracket 208 is seen to comprise an angle iron wherein the upper horizontal web portion 226 has a pair of male ball hitch members 228 fixedly bolted therein. As disclosed within FIG. 25, each one of the forwardmost vertically oriented beam members 22 of the framework structure 20 has a triangularly-shaped mounting bracket 230 fixedly mounted upon the upper end portion thereof, and a forwardly projecting support arm 232 is fixedly mounted atop each mounting bracket 230. The forwardmost end of each support arm 232 is integrally provided with a downwardly open female ball hitch sockets 234 for receiving and accommodating the male ball hitch members 228 mounted upon the horizontal leg member 212 of the support bracket 208. In this manner, when the female ball hitch sockets 234 are operatively engaged and connected to the male ball hitch members 228, the system and apparatus 10 of the present invention will be fixedly and operatively connected to the roadwork truck or vehicle 18. In order to provide further stability to this system for mounting the apparatus 10 of the present invention upon the roadwork truck or vehicle 18, an additional mounting bracket 236, similar to the mounting bracket 216, is bolted upon the side rail portion 30 of the roadwork vehicle or truck 18, as best seen in FIG. 23, and a bracing bar 238 has opposite ends thereof respectively interconnected as at 240, 242 to the horizontal leg member 212 of the support bracket 208 and to the mounting bracket 236.

Thus, it may be seen that in accordance with the principles and teachings of the present invention, there has been disclosed a new and improved system or apparatus for automatically retrieving and removing traffic cones from roadway surfaces wherein the system or apparatus comprises a knockdown bar for engaging upstanding traffic cones so as to effectively cause the traffic cones to be knocked down onto the roadway surface, and a horizontally disposed spearing mechanism for entering the open bottom or base portion of the knocked-down horizontally disposed traffic cone. The spearing mechanism is subsequently pivoted to a vertical orientation, and upon attaining such vertical orientation, the spearing mechanism is vertically elevated so as to pass by platform structure, formed by means of a pair of pivotal gate members, upon which the traffic cone can be supported when the gate members return to their original disposition. As subsequent traffic cones are serially mounted upon the platform structure, the traffic cones are automatically nested within a stacked array for storage purposes.

Obviously, many variations and modifications of the present invention are possible in light of the above teachings. It is therefore to be understood that within the scope of the appended claims, the present invention may be practiced otherwise than as specifically described herein.

The invention claimed is:

1. Apparatus for serially retrieving and removing a plurality of vertically oriented normally upstanding traffic cones from a roadway surface, comprising:

a framework adapted to be secured to a roadwork vehicle so as to be movable with the roadwork vehicle as the roadwork vehicle moves along the roadway surface;

a knockdown element mounted upon said framework for serially engaging a plurality of vertically oriented normally upstanding traffic cones as the roadwork vehicle moves along the roadway surface in order to respectively knock down each one of the plurality of traffic cones and thereby dispose each one of the plurality of traffic cones in a substantially horizontally oriented disposition;

an engagement element mounted upon said framework for serially grasping each one of the plurality of substantially horizontally oriented knocked-down traffic cones as the roadwork vehicle moves along the roadway surface so as to retrieve each one of the plurality of substantially horizontally oriented knocked-down traffic cones;

at least one gate member pivotally mounted upon said framework between a first, substantially vertically oriented OPEN position at which said at least one gate member permits each one of the plurality of traffic cones to pass thereby, and a second, substantially horizontally oriented CLOSED position at which said at least one gate member forms a platform upon which the plurality of traffic cones can be disposed;

first actuating means operatively connected to said engagement element for pivoting said engagement element between a first horizontally oriented position at which said engagement element can serially grasp each one of the plurality of substantially horizontally oriented knocked-down traffic cones, and a second vertically oriented position whereby each one of the plurality of knocked-down traffic cone will be oriented vertically; and second actuating means operatively connected to said engagement element for moving said engagement element, and each one of the plurality of vertically oriented traffic cones grasped thereby, upwardly toward and past said at least one gate member so as to move each one of the plurality of traffic cones toward and past said at least one gate member when said at least one gate member is disposed at said first, substantially vertically oriented OPEN position, and for moving said engagement element, and each one of the plurality of vertically oriented traffic cones grasped thereby, downwardly toward said at least one gate member so as to permit said enagement element to move past said at least one gate member and to permit each one of the plurality of vertically oriented traffic cones to be seated upon said at least one gate member when said at least one gate member is disposed at said second, substantially horizontally oriented CLOSED position at which said at least one gate member forms said platform upon which the plurality of traffic cones can be serially disposed in a stacked nested mode when successive ones of the plurality of traffic cones are successively moved upwardly past said at least one gate member.

2. The apparatus as set forth in claim 1, wherein:

said knock-down element comprises a horizontally disposed bar mounted upon said framework at a predetermined elevational level such that said knock-down bar can engage an upper region of each vertically oriented normally up-standing traffic cone so as to knock down each vertically oriented normally upstanding traffic cone and yet pass over each knocked-down horizontally oriented traffic cone.

3. The apparatus as set forth in claim 1, wherein:

said engagement element comprises a spearing mechanism which is adapted to be substantially axially inserted through an open base portion of each knocked-down horizontally oriented traffic cone so as to be substantially coaxially disposed within a hollow interior portion of each knocked-down horizontally oriented traffic cone.

4. The apparatus as set forth in claim 3, wherein:

said spearing mechanism has a substantially conical configuration.

5. The apparatus as set forth in claim 4, wherein:

a roller is rotatably mounted upon a forward tip portion of said substantially conical spearing mechanism so as to facilitate the entrance of said substantially conical spearing mechanism into the hollow interior portion of each traffic cone in said substantially coaxial disposition.

6. The apparatus as set forth in claim 1, wherein:

said first actuating means comprises a first dual-actuation piston-cylinder assembly operatively mounted upon a vertical slide mechanism; and said second actuating means comprises a second dual-actuation piston-cylinder assembly operatively interconnecting said vertical slide mechanism to said framework whereupon actuation of said second dual-actuation piston-cylinder assembly, said vertical slide mechanism is moved vertically upwardly and downwardly so as to in turn move said engagement element upwardly and downwardly with respect to said platform.

7. The apparatus as set forth in claim 1, further comprising:

first limit switch means engageable by each one of the plurality of horizontally oriented traffic cones disposed upon said engagement element so as to cause said first actuating means to pivot said engagement element from said first horizontally oriented position to said second vertically oriented position;

second limit switch means engageable by each one of the plurality of traffic cones disposed upon said engagement element as said engagement element is being pivoted by said first actuating means from said first horizontally oriented position to said second vertically oriented position; and a program logic controller (PLC) for controlling the actuation of said first and second actuating means in response to first and second signals received from said first and second limit switch means.

8. The apparatus as set forth in claim 7, further comprising:

kicker means movably mounted upon said framework for engaging a reversely oriented knocked-down traffic cone so as to cause the reversely oriented knocked-down traffic cone to resume its vertically oriented normally upstanding disposition in preparation for being knocked down toward a properly oriented knocked-down state by said knock-down element.

9. The apparatus as set forth in claim 8, wherein:

a dual-actuation piston-cylinder assembly is operatively connected to said kicker means for moving said kicker means between a first raised, inoperative position, and a second lowered operative position; and said program logic controller (PLC) is operatively connected to said dual-actuation piston-cylinder assembly for causing said dual-actuation piston-cylinder assembly to be moved to said first raised, inoperative position in response to said first signal from said first limit switch means.

10. The apparatus as set forth in claim 1, wherein:

said platform, comprising said at least one gate member, comprises a pair of spaced gate members pivotally mounted upon said framework between first substantially vertical positions at which said pair of spaced gate members permit said engagement element and a particular one of the plurality of traffic cones grasped thereby to pass by said pair of spaced gate members as said second actuating means elevates said engagement element, and the particular one of the plurality of traffic cones grasped thereby, whereby the particular one of the plurality of traffic cones can be inserted into the nested stack of traffic cones support upon said platform, and second substantially horizontal positions at which said pair of spaced gate members operatively cooperate together to form said platform upon which the plurality of traffic cones are supported in a stacked nested mode.

11. The apparatus as set forth in claim 10, wherein:

first and second coil springs are operatively associated with said pair of pivotally mounted spaced gate members for normally biasing said pair of spaced gate members toward said second substantially horizontal positions; and first and second stopper members are operatively associated with said pair of pivotally mounted spaced gate members for limiting the pivotal movements of said spaced gate members under the biasing forces of said first and second coil springs whereby said pair of spaced gate members will be properly disposed at said second substantially horizontal positions.

12. The apparatus as set forth in claim 7, further comprising:

third limit switch means operatively connected to said program logic controller (PLC) for causing said program logic controller (PLC) to actuate said second actuating means in an elevationally downward mode after said engagement element and a particular one of the plurality of traffic cones have attained a predetermined elevational level above said platform so as to permit the particular one of the plurality of traffic cones to be seated upon said platform.

13. In combination, apparatus for serially retrieving and removing a plurality of vertically oriented normally upstanding traffic cones from a roadway surface, comprising:

a roadwork vehicle;

a framework secured to said roadwork vehicle so as to be movable with said roadwork vehicle as said roadwork vehicle moves along the roadway surface;

a knock-down element mounted upon said framework for serially engaging a plurality of vertically oriented normally upstanding traffic cones as said roadwork vehicle moves along the roadway surface in order to respectively knock down each one of the plurality of traffic cones and thereby dispose each one of the plurality of traffic cones in a substantially horizontally oriented disposition;

an engagement element mounted upon said framework for serially grasping each one of the plurality of substantially horizontally oriented knocked-down traffic cones as said roadwork vehicle moves along the roadway surface so as to retrieve each one of the plurality of substantially horizontally oriented knocked-down traffic cones;

at least one gate member pivotally mounted upon said framework between a first, substantially vertically oriented OPEN position at which said at least one gate member permits each one of the plurality of traffic cones to pass thereby, and a second, substantially horizontally oriented CLOSED position at which said at least one gate member forms a platform upon which the plurality of traffic cones can be disposed;

first actuating means operatively connected to said engagement element for pivoting said engagement element between a first horizontally oriented position at which said engagement element can serially grasp each one of the plurality of substantially horizontally oriented knocked-down traffic cones, and a second vertically oriented position whereby each one of the plurality of knocked-down traffic cone will be oriented vertically; and second actuating means operatively connected to said engagement element for moving said engagement element, and each one of the plurality of vertically oriented traffic cones grasped thereby, upwardly toward and past said at least one gate member so as to move each one of the plurality of traffic cones toward and past said at least one gate member when said at least one gate member is disposed at said first, substantially vertically oriented OPEN position, and for moving said engagement element, and each one of the plurality of vertically oriented traffic cones grasped thereby, downwardly toward said at least one gate member so as to permit said enagement element to move past said at least one gate member and to permit each one of the plurality of vertically oriented traffic cones to be seated upon said at least one gate member when said at least one gate member is disposed at said second, substantially horizontally oriented CLOSED position at which said at least one gate member forms said platform upon which the plurality of traffic cones can be serially disposed in a stacked nested mode when successive ones of the plurality of traffic cones are successively moved upwardly past said at least one gate member.

14. The combination as set forth in claim 13, wherein:

said knockdown element comprises a horizontally disposed bar mounted upon said framework at a predetermined elevational level such that said knock-down bar can engage an upper region of each vertically oriented normally upstanding traffic cone so as to knock down each vertically oriented normally upstanding traffic cone and yet pass over each knocked-down horizontally oriented traffic cone.

15. The combination as set forth in claim 13, wherein:

said engagement element comprises a spearing mechanism which is adapted to be substantially axially inserted through an open base portion of each knocked-down horizontally oriented traffic cone so as to be substantially coaxially disposed within a hollow interior portion of each knocked-down horizontally oriented traffic cone.

16. The combination as set forth in claim 15, wherein:

said spearing mechanism has a substantially conical configuration.

17. The combination as set forth in claim 16, wherein:

a roller is rotatably mounted upon a forward tip portion of said substantially conical spearing mechanism so as to facilitate the entrance of said substantially conical spearing mechanism into the hollow interior portion of each traffic cone in said substantially coaxial disposition.

18. The combination as set forth in claim 13, wherein:

said first actuating means comprises a first dual-actuation piston-cylinder assembly operatively mounted upon a vertical slide mechanism; and said second actuating means comprises a second dual-actuation piston-cylinder assembly operatively interconnecting said vertical slide mechanism to said framework whereupon actuation of said second dual-actuation piston-cylinder assembly, said vertical slide mechanism is moved vertically upwardly and downwardly so as to in turn move said engagement element upwardly and downwardly with respect to said platform.

19. The combination as set forth in claim 13, further comprising:

first limit switch means engageable by each one of the plurality of horizontally oriented traffic cones disposed upon said engagement element so as to cause said first actuating means to pivot said engagement element from said first horizontally oriented position to said second vertically oriented position;

second limit switch means engageable by each one of the plurality of traffic cones disposed upon said engagement element as said engagement element is being pivoted by said first actuating means from said first horizontally oriented position to said second vertically oriented position; and a program logic controller (PLC) for controlling the actuation of said first and second actuating means in response to first and second signals received from said first and second limit switch means.

20. The combination as set forth in claim 19, further comprising:

kicker means movably mounted upon said framework for engaging a reversely oriented knocked-down traffic cone so as to cause the reversely oriented knocked-down traffic cone to resume its vertically oriented normally upstanding disposition in preparation for being knocked down toward a properly oriented knocked-down state by said knock-down element.

21. The combination as set forth in claim 20, wherein:

a dual-actuation piston-cylinder assembly is operatively connected to said kicker means for moving said kicker means between a first raised, inoperative position, and a second lowered operative position; and said program logic controller (PLC) is operatively connected to said dual-actuation piston-cylinder assembly for causing said dual-actuation piston-cylinder assembly to be moved to said first raised, inoperative position in response to said first signal from said first limit switch means.

22. The combination as set forth in claim 13, wherein:

said platform, comprising said at least one gate member, comprises a pair of spaced gate members pivotally mounted upon said framework between first substantially vertical positions at which said pair of spaced gate members permit said engagement element and a particular one of the plurality of traffic cones grasped thereby to pass by said pair of spaced gate members as said second actuating means elevates said engagement element, and the particular one of the plurality of traffic cones grasped thereby, whereby the particular one of the plurality of traffic cones can be inserted into the nested stack of traffic cones support upon said platform, and second substantially horizontal positions at which said pair of spaced gate members operatively cooperate together to form said platform upon which the plurality of traffic cones are supported in a stacked nested mode.

23. The combination as set forth in claim 22, wherein:

first and second coil springs are operatively associated with said pair of pivotally mounted spaced gate members for normally biasing said pair of spaced gate members toward said first substantially horizontal positions; and first and second stopper members are operatively associated with said pair of pivotally mounted spaced gate members for limiting the pivotal movements of said spaced gate members under the biasing forces of said first and second coil springs whereby said pair of spaced gate members will be properly disposed at said first substantially horizontal positions.

24. The combination as set forth in claim 19, further comprising:

third limit switch means operatively connected to said program logic controller (PLC) for causing said program logic controller (PLC) to actuate said second actuating means in an elevationally downward mode after said engagement element and a particular one of the plurality of traffic cones have attained a predetermined elevational level above said platform so as to permit the particular one of the plurality of traffic cones to be seated upon said platform.

25. A method of retrieving and removing vertically oriented normally upstanding traffic cones from a roadway surface, comprising the steps of:

attaching a framework to a roadwork vehicle such that said framework is movable along with the roadwork vehicle as the roadwork vehicle is moved along a roadway surface;

pivotally mounting at least one gate member upon said framework between a first, substantially vertically oriented OPEN position at which said at least one gate member permits each one of a plurality of traffic cones to pass thereby, and a second, substantially horizontally oriented CLOSED position at which said at least one gate member forms a platform upon which the plurality of traffic cones can be disposed;

serially knocking down each one of the plurality of vertically oriented normally upstanding traffic cones as the roadwork vehicle moves along the roadway surface in order to dispose each one of the plurality of traffic cones in a substantially horizontally oriented disposition;

spearing each one of the plurality of substantially horizontally oriented knocked-down traffic cones by a substantially horizontally oriented spearing element as said roadwork vehicle moves along the roadway surface so as to retrieve each one of the plurality of substantially horizontally oriented knocked-down traffic cones;

pivoting said spearing element from said horizontally oriented position to a vertically oriented position such that each retrieved traffic cone disposed upon said spearing element is now vertically oriented;

vertically elevating said spearing element, and each one of the plurality of vertically oriented traffic cones retrieved thereby, upwardly toward and past said at least one gate member so as to move each one of the plurality of traffic cones toward and past said at least one gate member when said at least one gate member is disposed at said first, substantially vertically oriented OPEN position; and vertically lowering said spearing element, and each one of the plurality of vertically oriented traffic cones retrieved thereby, toward said at least one gate member so as to permit said spearing element to move past said at least one gate member and to permit each one of the plurality of vertically oriented traffic cones to be seated upon said at least one gate member when said at least one gate member is disposed at said second, substantially horizontally oriented CLOSED position at which said at least one gate member forms said platform upon which the plurality of traffic cones can be serially disposed in a stacked nested mode when successive ones of the plurality of traffic cones are successively moved upwardly past said at least one gate member.

26. The method as set forth in claim 25, further comprising the step of:

actuating a kicker mechanism mounted upon said framework for engaging a reversely oriented knocked-down traffic cone so as to cause the reversely oriented knocked-down traffic cone to resume its vertically oriented normally upstanding disposition in preparation for being knocked down toward a properly oriented knocked-down state.

27. The method as set forth in claim 25, further comprising the step of:

removably mounting said framework upon said road.work vehicle by means of a male-female hitch mechanism.

* * * * *